US007086908B2

(12) United States Patent
Fukuzaki et al.

(10) Patent No.: US 7,086,908 B2
(45) Date of Patent: Aug. 8, 2006

(54) JACK

(75) Inventors: Hiroshi Fukuzaki, Kanagawa (JP); Satoru Kihira, Kanagawa (JP); Kiyoshi Washino, Kanagawa (JP); Tsuyoshi Fukami, Kanagawa (JP); Yuki Morita, Kanagawa (JP); Masaharu Takai, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/047,566

(22) Filed: Feb. 2, 2005

(65) Prior Publication Data

US 2005/0181664 A1 Aug. 18, 2005

(30) Foreign Application Priority Data

Feb. 3, 2004 (JP) ..... 2004-027307

(51) Int. Cl.
*H01R 24/04* (2006.01)

(52) U.S. Cl. ..... 439/669; 439/595; 439/521; 439/694

(58) Field of Classification Search ..... 439/669, 439/466, 350–352, 357, 135, 599, 746, 741, 439/733, 675, 676, 595, 521, 694
See application file for complete search history.

(56) References Cited

U.S. PATENT DOCUMENTS 6,250,952 B1 * 6/2001 Shiga et al. ..... 439/466
6,276,953 B1 * 8/2001 Gauker et al. ..... 439/352
6,435,894 B1 * 8/2002 Little et al. ..... 439/352
6,837,745 B1 * 1/2005 Takada et al. ..... 439/595
6,921,293 B1 * 7/2005 Takada et al. ..... 439/582

FOREIGN PATENT DOCUMENTS

| | | | |
|---|---|---|---|
| JP | 2000-268927 | A | 9/2000 |
| JP | 2000-353574 | A | 12/2000 |
| JP | 2001-237030 | A | 8/2001 |
| JP | 2001-244001 | A | 9/2001 |
| JP | 2002-270306 | A | 9/2002 |
| JP | 2003-217758 | A | 7/2003 |
| JP | 2003-303649 | A | 10/2003 |
| JP | 2003-332000 | A | 11/2003 |

* cited by examiner

*Primary Examiner*—P. Austin Bradley
*Assistant Examiner*—Edwin A. Leon
(74) *Attorney, Agent, or Firm*—Rader, Fishman & Grauer PLLC

(57) ABSTRACT

A jack with a hollow columnar contact has a housing, which holds the hollow columnar contact firmly and the front end of the hollow columnar contact does not deflect readily. The insulating housing 1 comprises a plug connection opening 61, which a mating plug 65 is inserted into, a first insertion chamber 9 having the plug connection opening 61, and a first opening 14 in communication with the contact insertion chamber 9. The hollow columnar contact 3 is inserted along an axial direction into the first insertion chamber from the first opening 14. A cylindrical main contact body 3*a* is held by the first opening 14. A press-fit pin 6, arranged with a small-diameter axial part 6*a*, a large-diameter axial part 6*b*, and a head part 6*c* having an outer diameter is press-fitted into the cylindrical main contact body 4*a*.

6 Claims, 15 Drawing Sheets

JACK

CROSS-REFERENCE TO RELATED APPLICATIONS

This application is based upon and claims the benefits of priorities from Japanese Patent Application No, 2004-027307 filed on Feb. 3, 2004, the entire contents of which are incorporated herein by reference.

FIELD OF THE INVENTION

The present invention relates to a jack to be used for transmitting electrical signals or energy in a notebook personal computer or other portable electronic equipment and particularly relates to the structure of a housing and contacts, etc., employed in such a jack.

RELATED ART

Portable electronic equipments operate on DC in many cases, and AC adapters are used to step down and, at the same time, convert the voltage of a household AC power supply to DC to provide power for portable electronic equipments. In many cases, a cable with plug is used as an AC adapter, and this plug is inserted into and electrically connected to a DC power supply jack provided with a portable electronic equipment to supply DC power to the portable electronic equipment.

As an example of such a power supply jack, there has been invented a jack having a structure, wherein a hollow columnar contact and a J-shaped contact are equipped, these contacts are electrically joined, respectively, to dedicated lead wires by crimping, the respective crimp parts are positioned in the interior of a housing of the jack, where the parts are unlikely to be subject to mechanical deformation, and mechanical forces are also unlikely to be applied to the respective crimp parts by the respective leads that extend outward from the jack (see for example, Japanese Published Unexamined Patent Application No. 2003-332000).

The jack by the above-mentioned Japanese Published Unexamined Patent Application Publication No. 2003-332000 is characterized in that contact failure is unlikely to occur even when mechanical deformation occurs during assembly or use.

FIGS. 17A to C are longitudinal sectional views of a jack by the invention of Japanese Published Unexamined Patent Application Publication No. 2003-332000. As shown in FIG. 17A, an insulating housing 1 is equipped with a circular plug connection opening 61 into which a mating plug is inserted. This housing 1 is equipped with a contact insertion chamber 9, having the plug connection opening 61 as an opening. Furthermore, the housing 1 is equipped with a contact insertion opening 14, which is in communication with the contact insertion chamber 9 and opposes the plug connection opening 61.

In FIG. 17A, a contact 3, which is conductive and has a hollow columnar shape, is inserted along the columnar axis into the contact insertion chamber 9 from the contact insertion opening 14. A root portion of a cylindrical main contact body 3*a* of the hollow columnar contact 3 is held by the contact insertion opening 14, equipped in the housing 1.

In FIG. 17A, the hollow columnar contact 3 has a hollow, columnar shape that is connected to an dedicated lead wire (not illustrated) by crimping at a crimp part 3*c*. The hollow columnar contact 3 is provided with a pair of L-shaped tongues 3*b*1 and 3*b*2 near a base part of hollow columnar shape that faces the crimp part 3*c*. In FIG. 17, among the opposing pair of L-shaped tongues 3*b*1 and 3*b*2, the L-shaped tongue 3*b*1 is invisible because it is behind the L-shaped tongue 3*b*2.

Meanwhile in FIG. 17A, a first latching part, which engages with the pair of L-shaped tongues 3*b*1 and 3*b*2 and restrains the rotation of the hollow columnar contact 3 about the columnar axis, is provided in the vicinity of the contact insertion opening 14. This first latching part may include the respective side walls of a lance 18 or may include a pair of slits, for which the respective side walls of a lance 18 are the inner walls at one side.

Furthermore, the above-mentioned pair of slits have steps formed therein and these steps serve as second latching parts that stop the hollow columnar contact 3 at a predetermined position of the housing 1. In the process of inserting the hollow columnar contact 3 into the contact insertion opening 14, the pair of L-shaped tongues 3*b*1 and 3*b*2 contact the above-mentioned steps to stop the hollow columnar contact 3 at the predetermined position.

Also, in FIG. 17A, the hollow columnar contact 3 furthermore has a column connecting base part and an engaging base part formed at the vicinity of the base part of the hollow columnar contact 3 that faces the crimp part 3*c*. The contact insertion opening 14 of the housing 1 is furthermore provided with a nose tip part 18*a*, which is formed on the lance 18 and serves as a third latching part for latching onto the above-mentioned engaging base part and thereby preventing the falling-off of the hollow columnar contact 3 from the housing 1.

This engaging base part engages with the nose tip part 18*a*, which serves as the third latching part of the housing 1, and restricts the movement of the hollow columnar contact 3 in the direction opposite the direction of insertion. The lance 18 prevents the falling off of the hollow columnar contact 3 from the housing 1 and prevents the hollow columnar contact 3 from being pushed in when the hollow columnar contact 3 engages with the mating plug.

However, since the hollow columnar contact 3 is latched by the lance 18 (more specifically, by nose tip part 18*a*) only at one portion in the circumferential direction, the main contact body 3*a* of the contact 3 may swing about the lance 18 as a supporting point as shown in FIG. 17B.

The main contact body 3*a* is loosely inserted into the contact insertion opening 14. That is, since the contact 3 is inserted into the contact insertion opening 14 with a predetermined clearance being provided, it is provided with the characteristic of being readily removable from the housing 1 by tilting the lance 18. Also, since, due to such clearance, the lance 18, which is the third latching part, latches onto one portion in the circumferential direction of the engaging base part of the contact, so-called deflection tends to occur readily at the front end of the main contact body 3*a*.

FIG. 17C is a longitudinal sectional view taken along a sectional plane orthogonal to the sectional plane of FIG. 17A. As shown in FIG. 17C, the housing 1 has installed therein a J-shaped contact 4, A movable elastic contact 4*e*, provided on the J-shaped contact 4, is put in elastic contact with the outer circumference of an inserted terminal of a plug 65.

As shown in FIG. 17B or 17C, if the cylindrical main contact body 3*a* is tilted, this will not give a good impression to a user. Furthermore, as illustrated in the sectional view of FIG. 17C, the insertion of the plug 65 may be made difficult. Furthermore, the tilted contact 3 may be pushed by the plug 65 and become disengaged from the lance 18.

SUMMARY OF THE INVENTION

This invention has been made to resolve the above issues and an object thereof is to provide a jack with hollow columnar contact, having a structure with which the hollow columnar contact is held firmly onto the housing and the front end of the hollow columnar contact will not deflect readily.

With this invention, a structure for press-fitting a press-fit pin into a cylindrical main contact body can be provided. Specifically, a jack such as the following is provided.

(1) A jack comprising: an insulating housing and a hollow columnar contact; wherein the insulating housing comprises: a plug connection opening into which a mating plug is inserted; a contact insertion chamber having an opening of the plug connection opening; and a contact insertion opening being disposed opposite to the plug connection opening, the contact insertion opening communicating with the contact insertion chamber; wherein the hollow columnar contact being conductive is inserted along an axial direction thereof into the contact insertion chamber from the contact insertion opening, wherein the jack holds a cylindrical main contact body of the hollow columnar contact at the contact insertion opening of the housing; and wherein a press-fit pin is press-fitted inside the cylindrical main contact body.

(2) The jack according to (1), wherein the hollow columnar contact is a contact with a hollow and columnar shape, and is connected to a dedicated lead Wire by crimping at a crimp part, wherein the hollow columnar contact comprises a pair of L-shaped tongues provided in a vicinity of a base part of the hollow columnar shape, the base part being provided toward the crimp part; and wherein the contact insertion opening, into which the hollow columnar contact is inserted along the axial direction, comprises: a first latching part being provided in a vicinity of the contact insertion opening, the first latching part engaging with the pair of L-shaped tongues and restrains the rotation of the hollow columnar contact about the axial direction; a second latching part to contact with the pair of L-shaped tongues as the hollow columnar contact is inserted into the contact insertion opening such that the hollow columnar contact is stopped at a predetermined position, wherein the hollow columnar contact further comprises column connecting base part and an engaging base part in a vicinity of the base part of the hollow columnar contact toward the crimp part, wherein the contact insertion opening of the housing further comprises a third latching part for contacting with the engaging base part so as to prevent the hollow columnar contact from falling off the housing, wherein the press-fit pin comprises a small-diameter axial part having an outer diameter smaller than the inner diameter of the cylindrical main contact body, a large-diameter axial part having an outer diameter for a "medium fit" of fit quality with the inner diameter of the cylindrical main contact body, and a head part having an outer diameter larger than the outer diameter of the large-diameter axial part such that the outer diameter pushes and spreads the pair of L-shaped tongues, and wherein the small-diameter axial part, the large-diameter axial part, and the head part are arranged to be coaxial, and the press-fit pin is press-fitted into the cylindrical main contact body.

(3) The jack according to (1) or (2), wherein the above-mentioned press-fit pin is formed of a hard metal of good electroconductivity.

(4) A jack comprising: a columnar contact of a columnar shape and an insulating housing which houses the columnar contact; wherein the insulating housing comprises: a plug connection opening, into which a mating plug is inserted; a contact insertion chamber for receiving the mating plug to be inserted from the plug connection opening; and a contact insertion opening being in communication with the contact insertion chamber via a cylindrical passage that has a cylindrical shape of predetermined length and being provided as opposed to the plug connection opening; wherein the columnar contact comprising is a cylindrical hollow part is in a hollow columnar shape with conductivity and is inserted along an axial direction into the contact insertion chamber from the contact insertion opening, wherein the contact insertion opening and the cylindrical passage have inner diameters of substantially the same size, which is substantially the same as or slightly larger than the outer diameter of the columnar contact so as to enable the columnar contact to be inserted readily, and wherein a press-fit pin is press-fitted into the hollow part of the hollow columnar shape of the columnar contact, (5) The jack according to (4), wherein the above-mentioned press-fit pin is provided with a large diameter axial part with an outer diameter that is substantially the same as or slightly larger than the inner diameter of the hollow part of the above-mentioned columnar contact.

(6) The jack according to (4) or (5); wherein the columnar contact comprises: a crimp part to be connected by crimping with a lead wire; and a pair of L-shaped tongues being provided in a vicinity of a base part of the hollow columnar shape being provided toward the crimp part; wherein the contact insertion opening, into which the hollow columnar contact is inserted along an axial direction, comprises: a first latching part being provided in a vicinity of the contact insertion opening, the first latching part engaging with the pair of L-shaped tongues so as to restrains rotation of the hollow columnar contact about the axial direction; and a second latching part to contact with the pair of L-shaped tongues as the hollow columnar contact is inserted into the contact insertion opening to stop the hollow columnar contact at a predetermined position, wherein the columnar contact further comprises a column connecting base part and an engaging base part in a vicinity of the base part, wherein the contact insertion opening of the housing further comprises a third latching part for latching onto the engaging base part and thereby preventing falling-off of the columnar contact from the housing, and wherein the press-fit pin comprises a small-diameter axial part with an outer diameter smaller than the inner diameter of the hollow part; a large-diameter axial part with an outer diameter that is substantially the same as or slightly larger than the inner diameter of the hollow part; and a head part with an outer diameter having a larger outer diameter than that of the large-diameter axial part such that the outer diameter is inserted to push and spread the pair of L-shaped tongues, wherein the small-diameter axial part, the small-diameter axial part, and the head part are provided in the order from a front end of the pin in the insertion direction to be coaxial.

(7) An electrical device equipped with the jack of any one of (1) to (6) above.

The invention of (1) provides a jack, wherein an insulating housing is equipped with: a plug connection opening, into which a mating plug is inserted; a contact insertion chamber, having the above-mentioned plug connection opening as an opening; and a contact insertion opening, being in communication with the above-mentioned contact insertion chamber and opposing the above-mentioned plug connection opening; a hollow columnar contact, which is conductive, is inserted along the columnar axis into the above-mentioned contact insertion chamber from the above-mentioned contact insertion opening, and a cylindrical main contact body of the above-mentioned hollow columnar contact is held by the above-mentioned contact insertion opening, equipped in the above-mentioned housing, and a press-fit pin may be press-fitted into the above-mentioned cylindrical main contact body.

The plug connection opening may be an opening into which the mating plug is inserted from the exterior of the housing and it is sufficient for the opening to have an area and shape for insertion of the mating plug. Also, the plug connection opening may be an opening that opens only when the mating plug is inserted and may include an opening equipped with a mechanism, with which the opening is sealed, for example, by a door joined by a hinge and the above-mentioned door opens in conjunction with the insertion of the mating plug.

The plug connection opening may have a shape that matches the inserted terminal of the mating plug and may be of a circular shape or of a rectangular shape, including a square shape. In the case where the plug connection opening is circular the contact insertion chamber becomes a space with a cylindrical shape, and in the case where the plug connection opening is rectangular, the contact insertion chamber becomes a space with a rectangular parallelepiped shape.

The contact insertion chamber is a space that includes a location for holding or housing the contact and may include an arrangement that is formed inside the housing. A part of the contact may be positioned by being inserted into, held by, or housed in, etc., the contact insertion chamber.

The contact insertion opening, which is in communication with the contact insertion chamber, has a cross-sectional shape that enables the insertion of the contact. The contact insertion chamber, having the contact insertion opening as an opening, is a space with a width (thickness) that holds the contact partially and may include an arrangement that is formed inside the housing. The contact insertion chamber, having the contact insertion opening, which holds the cylindrical main contact body, as an opening, is preferably a cylindrical space and a lance may protrude into or a slit may be formed in communication with the contact insertion opening.

The hollow columnar contact that is held by the contact insertion opening equipped in the housing is held comparatively loosely in order to facilitate removal from the housing. With this invention, by press-fitting a press-fit pin into the cylindrical main contact body, the hollow columnar contact is held firmly by the housing and the front end of the hollow columnar contact is prevented from deflecting readily. Yet the facilitation of removal of the hollow columnar contact from the housing is not eliminated.

The invention of (2) provides the jack according to (1), wherein the above-mentioned hollow columnar contact is a contact with a hollow, columnar shape that is connected to a dedicated lead wire by crimping at a crimp part, the above-mentioned hollow columnar contact has a pair of L-shaped tongues provided near a base part of hollow columnar shape that faces the above-mentioned crimp part, the above-mentioned contact insertion opening, into which the above-mentioned hollow columnar contact is inserted along the columnar axis, is provided, at the vicinity of the above-mentioned contact insertion opening, with a first latching part, which engages with the above-mentioned pair of L-shaped tongues and restrains the rotation of the above-mentioned hollow columnar contact about the columnar axis, and a second latching part, which contacts the above-mentioned pair of L-shaped tongues in the process of insertion of the above-mentioned hollow columnar contact into the above-mentioned contact insertion opening and stops the above-mentioned hollow columnar contact at a predetermined position, the above-mentioned hollow columnar contact furthermore has a column connecting base part and an engaging base part at the vicinity of the base part of the above-mentioned hollow columnar contact that faces the above-mentioned crimp part, the above-mentioned contact insertion opening of the above-mentioned housing is furthermore provided with a third latching part for latching onto the above-mentioned engaging base part and thereby preventing the falling-off of the above-mentioned hollow columnar contact from the above-mentioned housing, the above-mentioned press-fit pin has a small-diameter axial part, with an outer diameter smaller than the inner diameter of the above-mentioned cylindrical main contact body, a large-diameter axial part, with an outer diameter for a "transition fit" fitting with the inner diameter of the above-mentioned cylindrical main contact body, and a head part, with an outer diameter that is larger than the outer diameter of the above-mentioned large-diameter axial part and is an outer diameter that pushes and spreads the above-mentioned pair of L-shaped tongues, and is arranged so that the axial centers of the respective parts are coaxial, and the above-mentioned press-fit pin may be press-fitted into the above-mentioned cylindrical main contact body.

The dedicated lead wire may be a lead wire, which is connected to a power supply circuit, incorporated in an electric equipment to which the present jack is mounted, and transmits the power supply power. A lead wire is an electrical wire, with which a conductive core material is covered with an insulating cladding material. The lead wire may be a single wire or a multiple wire of two or more wires.

Connection by crimping may generally be achieved by providing, in a crimp terminal, a crimp part, at which a partial member of the terminal is bent so as to enfold the core material of a lead wire, etc., and thereby fix the core material, to achieve electrical (and, at times, mechanical) connection by this fixing. A so-called conductor grip may be provided. Also, the lead wire may be fixed mechanically by means of bending so as to enfold the lead wire from above the insulating cladding material. A so-called insulation grip may be provided.

The hollow columnar contact may take on a form that includes a shape, with which the interior of a column is made hollow, such as an arrangement formed by bending a plate material to cylindrical form by means of a press, etc. Here, an opening is formed at a base part. The base part may refer to the vicinity of the end of the columnar shape that is closer to the crimp part. Unlike the base part, the front end on the side opposite to the base part is closed, and this may be considered to improve the property of engagement with a mating plug for connection as well as the appearance of itself.

The L-shaped tongues may include tongues, which are positioned in the vicinity of the base part of the hollow columnar contact and extend substantially perpendicular with respect to the columnar axis. The insertion chamber has a shape enabling the insertion of the hollow columnar contact and has a shape with which insertion is performed in the columnar axis direction.

The column connecting base part may refer to a hollow columnar contact portion that is provided at the base side of the cylindrical portion of hollow columnar shape and extends in continuation from the above-mentioned cylindrical portion member, This portion may be disposed at a position at which it is sandwiched by the above-mentioned pair of L-shaped tongues.

The engaging base part is the end or side at the base side of the cylindrical portion of hollow columnar shape in the above-mentioned hollow columnar contact and, in a view viewing the above-mentioned cylindrical portion upward from the bottom face, is positioned at the side of the face opposite the above-mentioned column connecting base part.

This engaging base part engages with the third latching part of the housing to restrict movement of the hollow columnar contact in the direction opposite the insertion direction to prevent the falling-off of the hollow columnar contact and is considered to be able to prevent the pushing in of the hollow columnar contact when the contact is engaged with a plug.

The above-mentioned third latching part is a protrusion provided on the housing, and though by its elastic property, the third latching part is made to retreat by an outer wall of the column portion during insertion of the hollow columnar contact, once the insertion of the hollow columnar contact is completed and once the above-mentioned engaging base part is moved past the above-mentioned third latching part the third latching part may protrude into the insertion path of the contact 80 as to engage with the above-mentioned engaging base part. This engaging base part and the third latching part are referred to, for example, as lances in some cases.

The press-fit pin is equipped with a small-diameter axial part, having an outer diameter that is smaller than the inner diameter of the cylindrical main contact body. In the state in which this press-fit pin is press-fitted inside the cylindrical main contact body, the small-diameter axial part provides a gap in the interior of the cylindrical main contact body. By thus providing a gap inside the main contact body, not only can the main contact body be made compressible when a plug is fitted but it is also considered that a heat radiating effect is provided as well.

The press-fit pin is also equipped with a large-diameter axial part, having an outer diameter with which the fitting with the inner diameter of the cylindrical main contact body will be a "transition fit." In the state in which this press-fit pin is press-fitted inside the cylindrical main contact body, the large-diameter axial part is held so as to be in close contact with the interior of the cylindrical main contact body.

The portion of the large-diameter axial part of the press-fit pin corresponds to the portion at which the cylindrical main contact body is held by the contact insertion opening provided in the housing. By the large-diameter axial part being inserted at the root portion of the cylindrical main contact body, which is otherwise held by a thin cylinder, a rigid axis that can withstand compression in the direction of the central axis is formed.

Furthermore, the press-fit pin is equipped with a head part, having an outer diameter that is larger than the outer diameter of the large-diameter axial part and pushes and spreads the pair of L-shaped tongues. In the state in which this press-fit pin is press-fitted inside the cylindrical main contact body, the head part pushes and spreads the pair of L-shaped tongues and thus deforms the pair of L-shaped tongues. The deformed pair of L-shaped tongues contact the walls at both flanks and firmly hold the root portion of the main contact body.

The press-fit pin, which thus makes the hollow columnar contact be held firmly in the housing and resolves the deflection of the front end of the hollow columnar contact is formed, for example, from a copper alloy or other hard metal of good electroconductivity and may be formed by forging or rolling.

This invention's jack is a jack having a hollow columnar contact, and since a press-fit pin is press-fitted inside a cylindrical main contact body, the cylindrical main contact body is held firmly by the housing and the front end of the hollow cylindrical contact will not deflect. Since the visible orientation of the cylindrical main contact body is stable, a user is provided with a sense of security and causes of connection failure can be eliminated.

Further features of the invention, its nature, and various advantages will be more apparent from the accompanying drawings and the following detailed description of the invention.

DESCRIPTION OF THE PREFERRED EMBODIMENT

The preferred embodiment of the present invention will be described below in reference to the drawings. However, the present invention is not limited to the embodiment, and various modifications and changes in design can be made without departing from the scope of the invention.

In regard to the embodiment, since this invention's jack is equipped with a hollow columnar contact and a J-shaped contact, a contact insertion chamber, into which the hollow columnar contact is inserted, shall be referred to as a "first insertion chamber" and a contact insertion chamber, into which the J-shaped contact is inserted, shall be referred to as a "second insertion chamber" to distinguish between the two in the following description.

Also, a contact insertion opening, which is to be an opening of the "first insertion chamber," shall be referred to as a "first opening" and a contact insertion opening, which is to be an opening of the "second insertion chamber," shall be referred to as a "second opening" to distinguish between the two in the following description.

Figure 17:
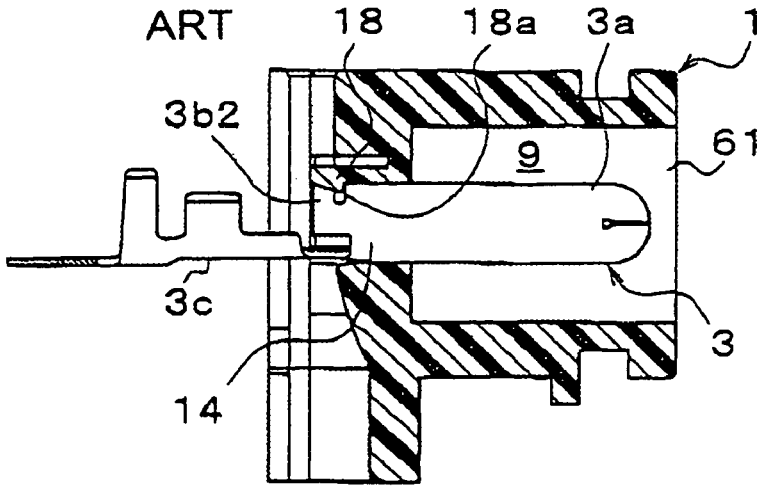
Fig. 17 A PRIOR ART
FIGS. 17A to C are Longitudinal sectional views of a jack by a prior art.
Figure 17:
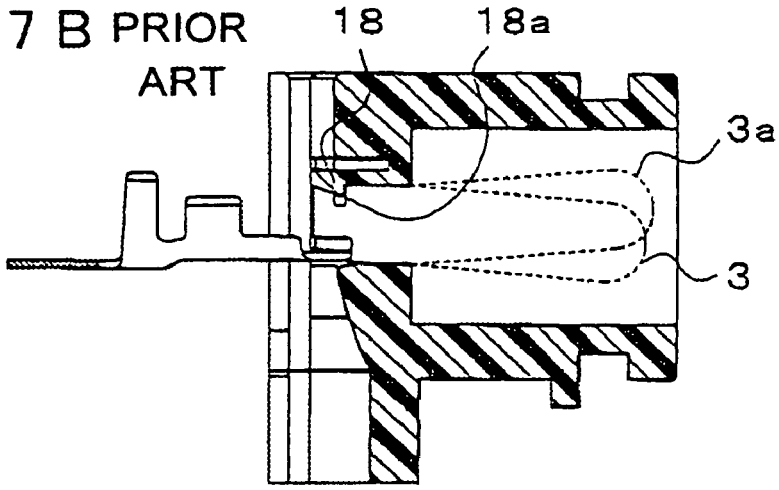
Fig. 17 B PRIOR ART
Figure 17:
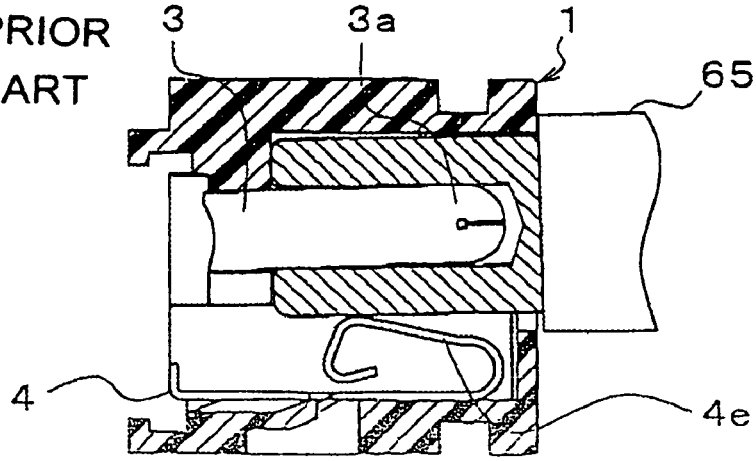
Fig. 17 C PRIOR ART

The structure and functions of the embodiment shall first be described briefly and then a detailed description shall be provided in reference to the respective drawings. The same symbols used in FIGS. 17A to C, which show a prior art, shall be used in the following description.

Figure 13:
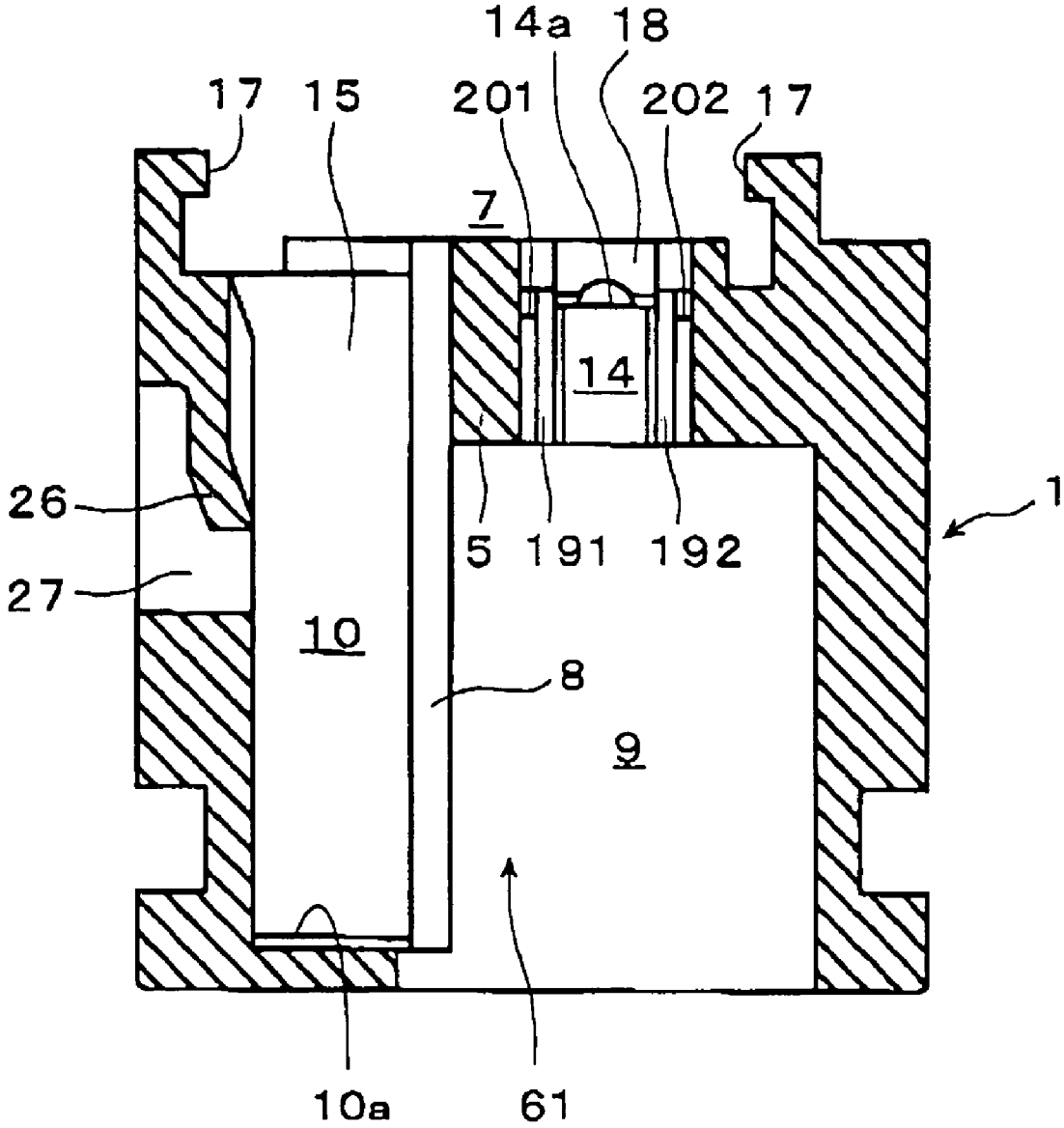
FIG. 13 is a sectional view taken along arrows B—B of FIG. 11.

FIG. 13 is a sectional view of a housing and is a sectional view taken along arrows B—B of FIG. 11, to be described later. As shown in FIG. 13, in the interior of the housing 1, a contact insertion opening 7 is positioned at the upper side of a partition wall 5. Also, the interior of the housing 1 is partitioned by a partition wall 8 into the two types of contact insertion chambers 9 and 10.

Figure 9:
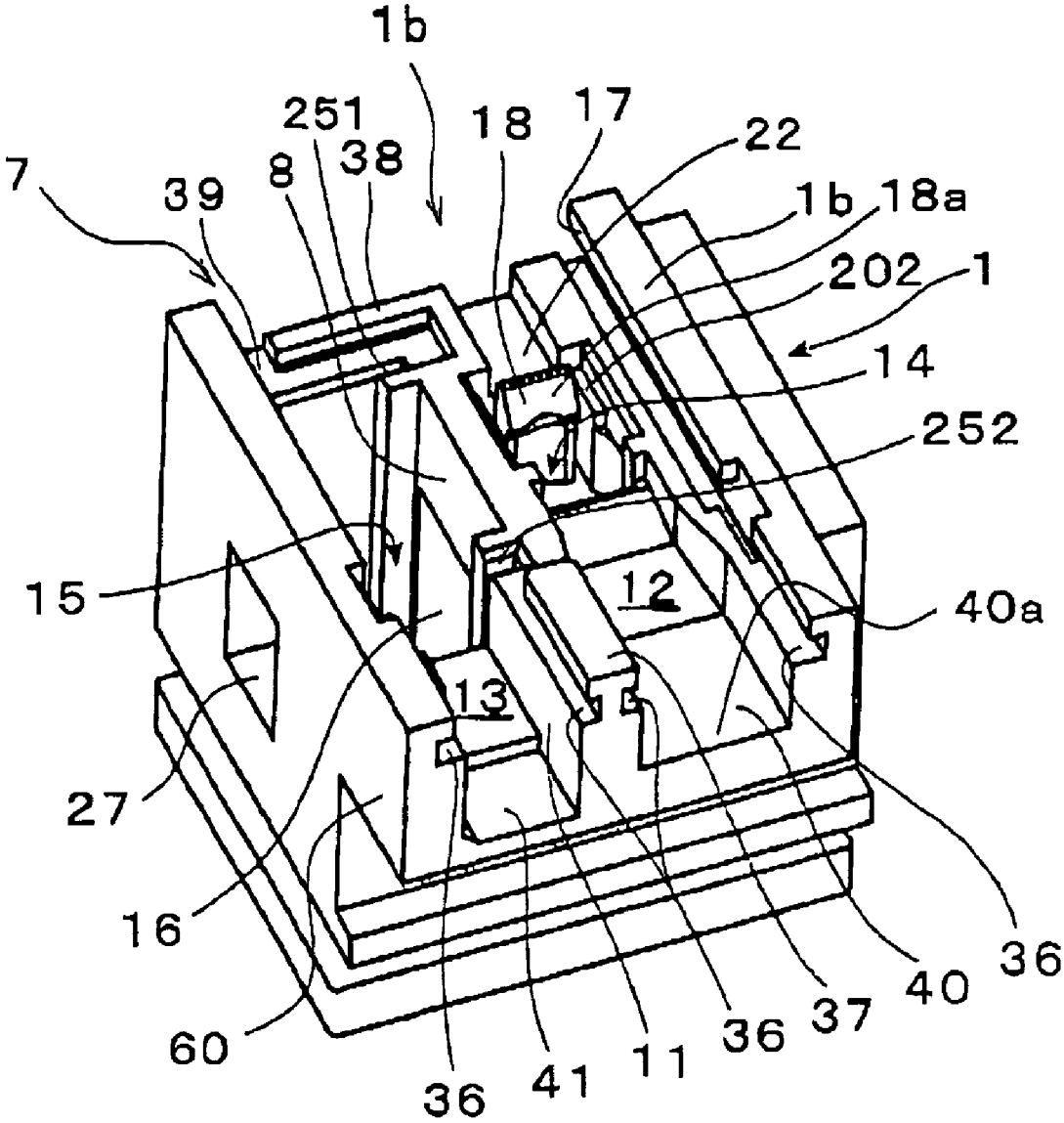
FIG. 9 is a perspective view of a housing as seen from the back side.

Meanwhile, FIG. 9 is a perspective view of the housing as viewed from the back side. As shown in FIG. 9, the housing is partitioned by a partition wall 11 into the two parts of crimp part housing parts 12 and 13. Returning now to FIG. 13, a first opening 14 and a second opening 15, to be used as contact insertion holes, are formed in the partition wall 5, and these are in communication with a first insertion chamber 9 and a second insertion chamber 10, respectively.

Figure 14:
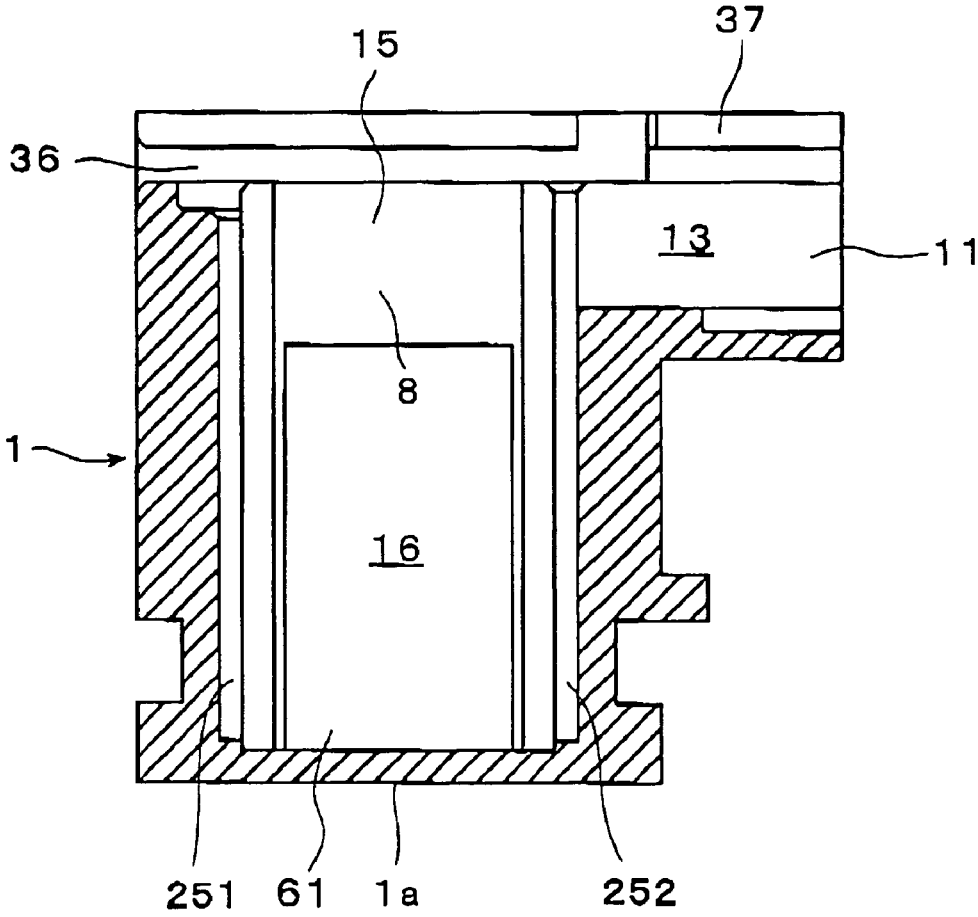
FIG. 14 is a sectional view taken along arrows C—C of FIG. 11.

Also, as shown by the embodiment in FIG. 14, the first insertion chamber 9 and the second insertion chamber 10 are put in communication with each other by a plug connection opening 61 of a partition wall 8. The contact insertion opening 7 is formed in a back face 1*b* (see FIG. 9) of the housing 1 so as to face the entirety.

Figure 11:
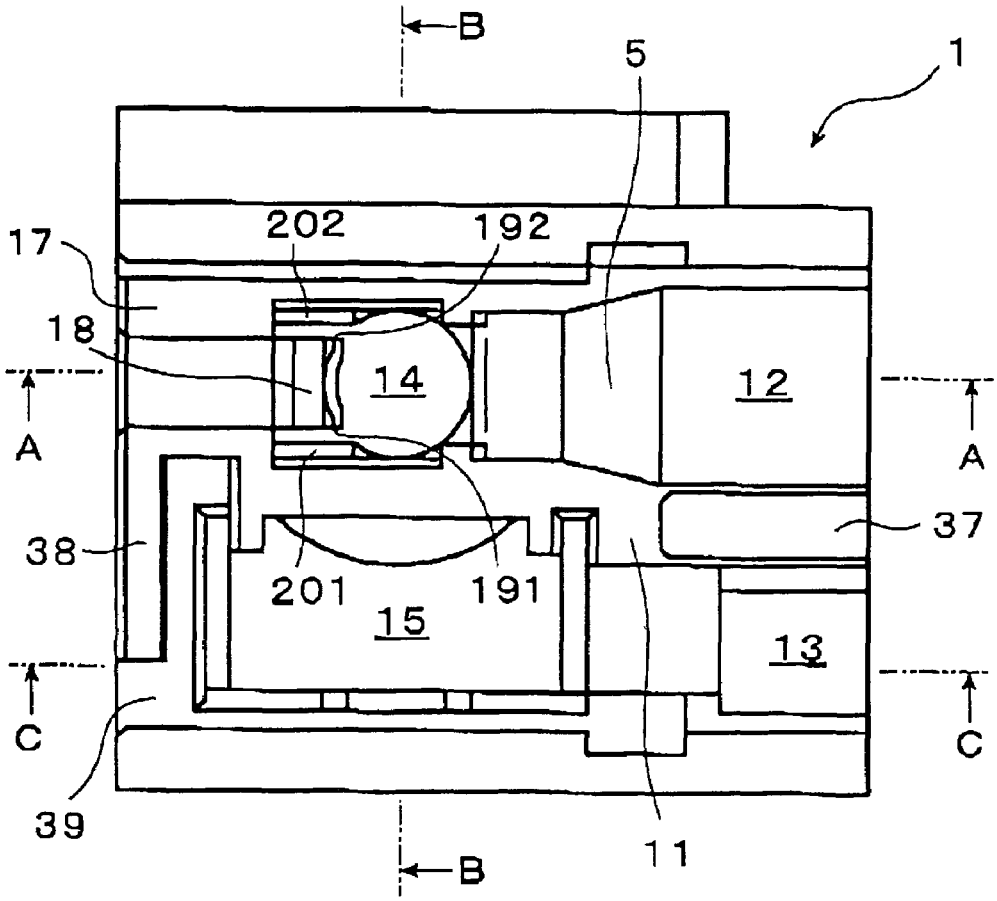
FIG. 11 is a plan view of FIG. 9.

FIG. 11 is a plan view of FIG. 9. As shown in FIG. 11, a lance 18, which is formed integral to the partition wall 5, is disposed at a peripheral part of the first opening 14. A pair of slits 191 and 192 are disposed at the respective sides of this lance 18, and steps 201 and 202 are formed at middle portions of the pair of slits 191 and 192, respectively.

Figure 2:
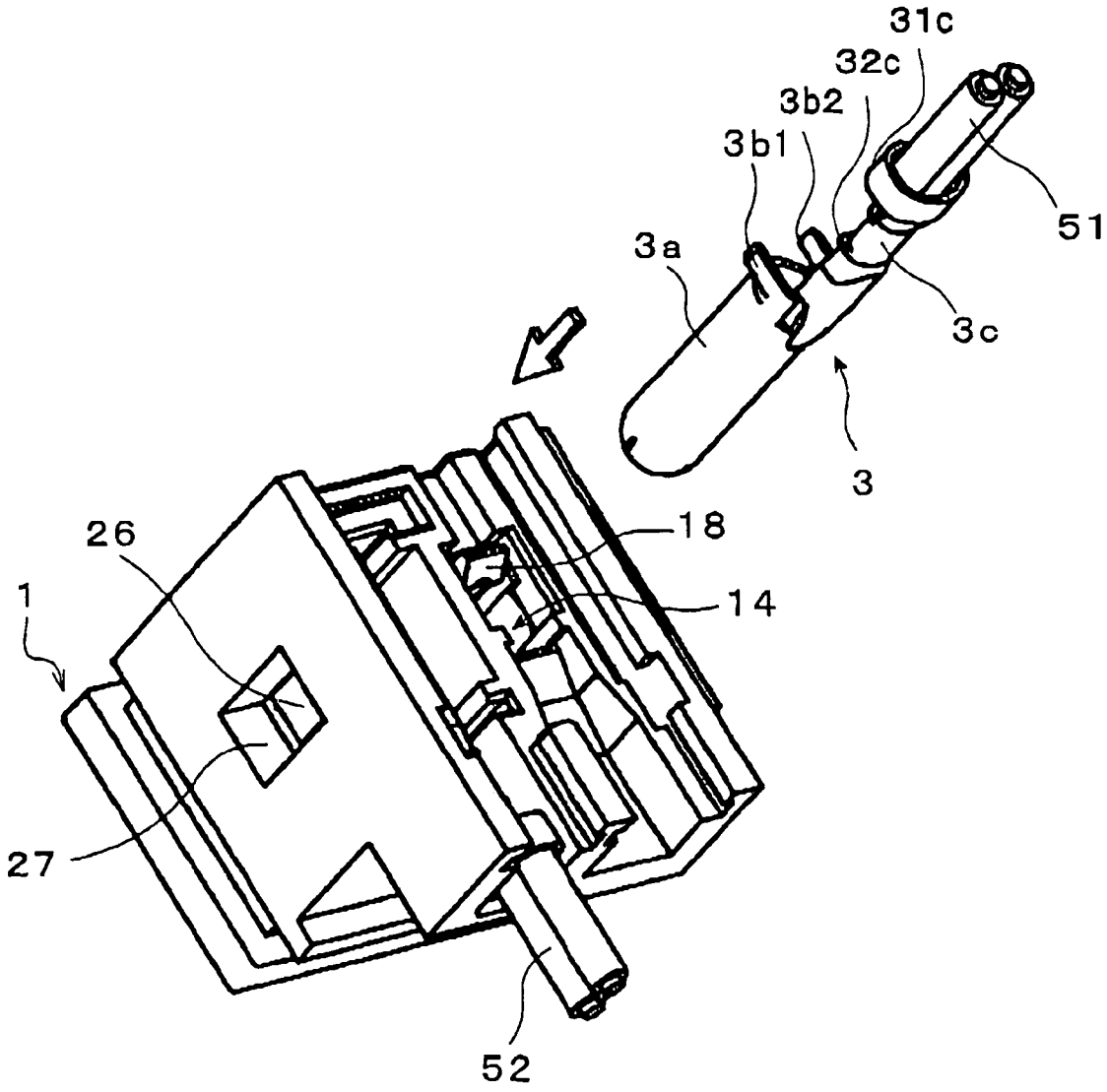
FIG. 2 is a perspective view illustrating an assembly procedure (insertion of a hollow columnar contact) of the jack, which is this invention's embodiment.

FIG. 2 is a perspective view illustrating an assembly procedure (insertion of a hollow columnar contact) of the jack, which is this invention's embodiment. As shown in FIG. 2, a hollow columnar contact 3, which is inserted in the first opening 14, is formed by the pressing of a plate material. The hollow columnar contact 3 shown in FIG. 2 is equipped with a cylindrical main contact body 3*a*. Furthermore, the hollow columnar contact 3 is equipped with a pair of L-shaped tongues 3*b*1 and 3*b*2, which are disposed in the vicinity of a base part of the main contact body 3*a*, and with a first crimp part 3*c*, which is extended from the base part of the main contact body 3*a* so as to be connected with a lead wire 51.

As shown in FIG. 2, when the main contact body 3*a* is inserted into the first opening 14 with the orientations of the pair of L-shaped tongues 3*b*1 and 3*b*2 being matched with those of the pair of slits 191 and 192 (see FIG. 13), the pair of L-shaped tongues contact the pair of steps 201 and 202 (see FIG. 13), thereby stopping the entry of the main contact body 3*a* into the contact insertion chamber 9 (see FIG. 13).

Furthermore, the lance 18, shown in FIG. 2, engages with an engaging base part of the main contact body 3*a* so that the retreating of the main contact body 3*a* is also prevented, and the main contact body 3*a* is thus held at a predetermined position. Since the pair of L-shaped tongues 3*b*1 and 3*b*2 are sandwiched in the pair of slits 191 and 192 (see FIG. 13), the rotation of the main contact body 3*a* is also prevented.

FIG. 14 is a sectional view of the housing, and is a sectional view taken along arrows C—C of FIG. 11, to be described later. As shown in FIG. 14, the second opening 15 is formed to have a rectangular cross section. At the respective corners at the partition wall 8 side that are formed in the second opening 15, a pair of guide grooves 251 and 252 are formed in the front/back direction.

Returning now to FIG. 13, a small piece (or lance) 26 is disposed at a location opposing an opening 16 (see FIG. 14) at the back face of the second insertion chamber 10. As shown in FIG. 13, this small piece 26 is formed by extension of a thin part, with a V-shaped cross section, from a peripheral edge of a window 27 of the housing 1.

Figure 10:
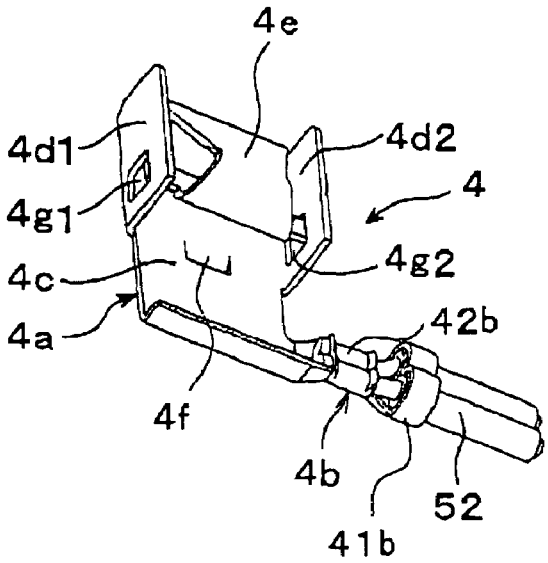
FIG. 10 is a perspective view of the J-shaped contact.

FIG. 10 is a perspective external view of a J-shaped contact. The J-shaped contact 4 is formed by the pressing of a plate material and is arranged from a main contact body 4*a* and a crimp part 4*b*, which is for connection with a lead wire 52 and extends substantially at a right angle from a base end part of the main contact body 4*a*.

The J-shaped contact 4, shown in FIG. 10 is equipped with the J-shaped main contact body 4*a*. The main contact body 4*a* is arranged from a rectangular back plate 4*c*, of substantially rectangular shape, and a pair of guide plates 4*d*1 and 4*d*2, which extend upon being bent from the respective side edges of the rectangular back plate 4*c*. The main contact body 4*a* is furthermore equipped with an elastic movable contact 4*e*, which is folded back at a bent part at the lower side of the rectangular back face plate 4*c*, and a wedge-like raised part (or lance) 4*f*, provided at a central part of rectangular back plate 4*c*.

As shown in FIG. 10, by engaging the respective ends of an extended member at the front end of elastic movable contact 4*e* with openings 4*g*1 and 4*g*2, formed in the pair of guide plates 4*d*1 and 4*d*2, the variable stroke of the elastic movable contact 4*e* in the process of insertion or extraction of a plug can be restricted.

Figure 1:
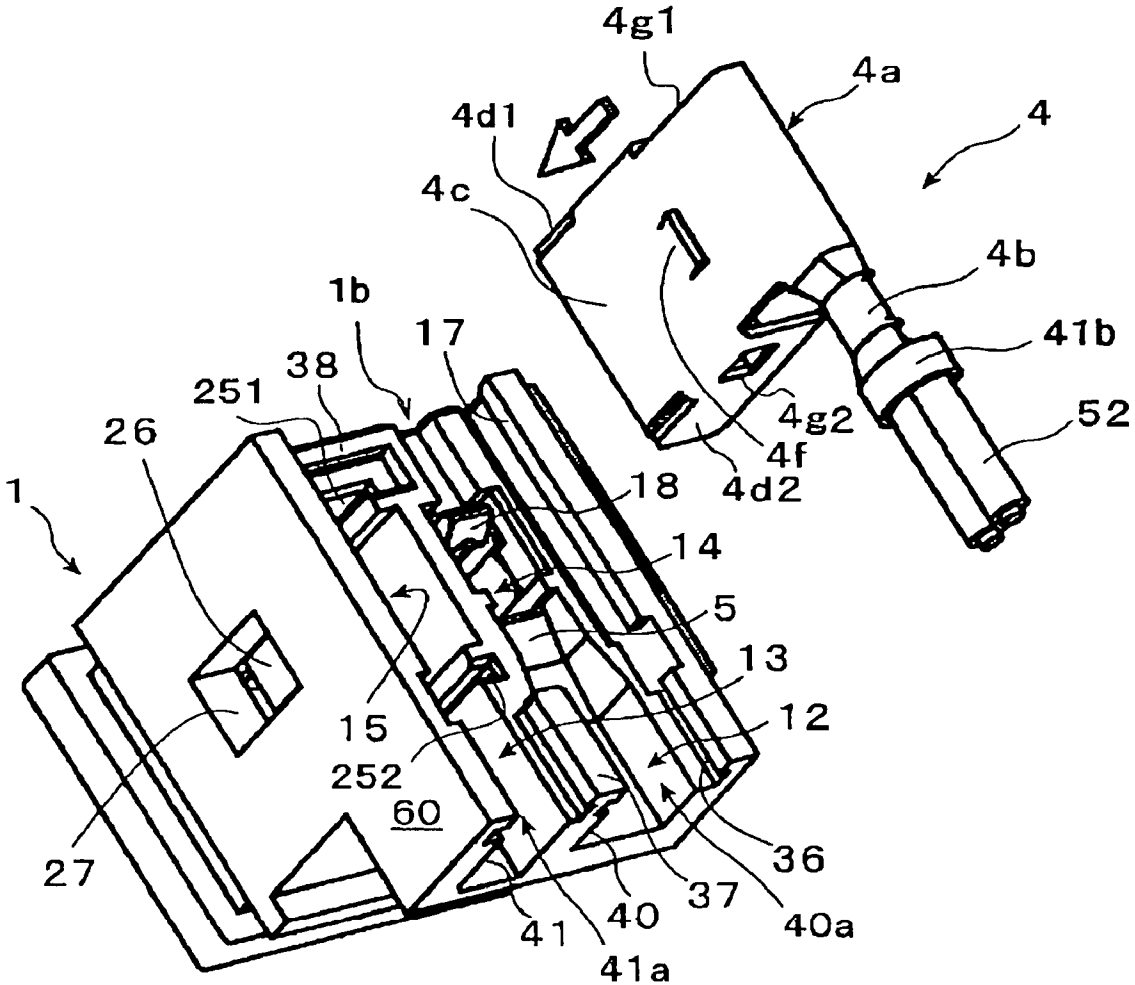
FIG. 1 is a perspective view illustrating an assembly procedure (insertion of a J-shaped contact) of a jack, which is an embodiment of this invention.

FIG. 1 is a perspective view illustrating an assembly procedure (insertion of the J-shaped contact) of the jack, which is this invention's embodiment. As shown in FIG. 1, in mounting the J-shaped contact 4 to the housing 1, the pair of guide plates 4*d*1 and 4*d*2 are engaged with guide grooves 251 and 252 and the main contact body 4*a* is inserted into the second opening 15.

When the front ends (corresponding to the front end edges) of the pair of guide plates 4*d*1 and 4*d*2, shown in FIG. 10, contact a bottom inner wall 10*a* of the second insertion chamber 10 (see FIG. 13), further entry of the main contact body 4*a* is prevented and the lance 28 (see FIG. 13) engages with the lance 4*f* to prevent retreating of the main contact body 4*a*.

The main contact body 4*a*, shown in FIG. 10, is thereby held at a predetermined position of the second insertion chamber 10 (see FIG. 13). At this time, the elastic movable contact 4*e* protrudes into the contact insertion chamber 9 (see FIG. 13) at the positive pole side from the opening 16 (see FIG. 14) of the partition wall 8.

As shown in FIG. 9, the housing 1 has a pair of guide grooves 36 formed along the respective side edges of the contact insertion opening 7. Furthermore, a pair of guide grooves 36 are also formed in a stopper 37, protruded from the upper face of the partition wall 11. On the upper face of the partition wall 5 (see FIG. 11) is formed a raised part 38, which is continuous with the partition wall 8, and a recessed part 39, is formed adjacent the front end of this raised part 38. Also, lead wire insertion parts 40 and 41, which are in communication with the crimp part housing parts 12 and 13, are formed.

Figure 5:
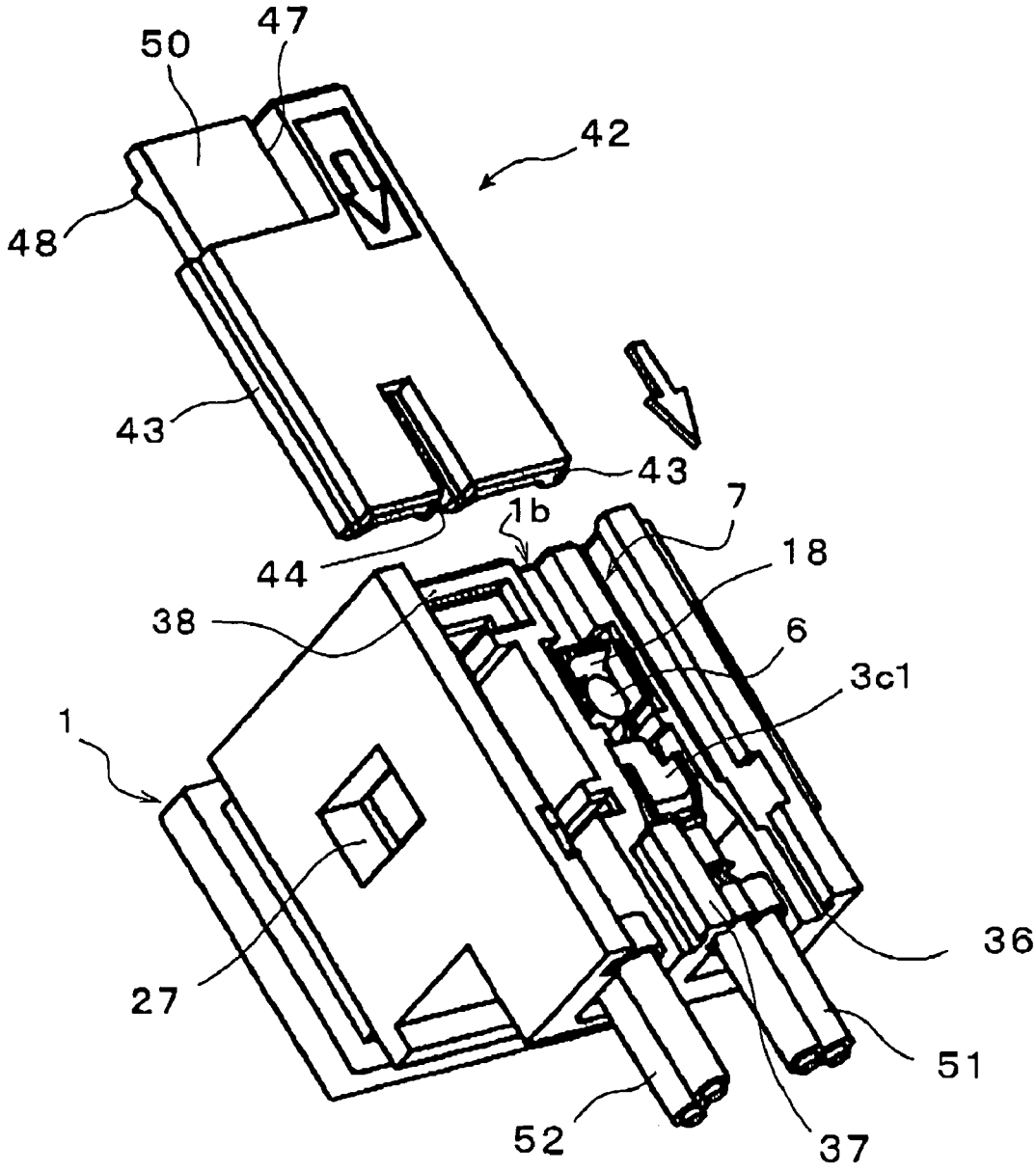
FIG. 5 is a perspective view illustrating an assembly procedure (engagement of a cover) of the jack, which is this invention's embodiment.

FIG. 5 is perspective view illustrating an assembly procedure (engagement of a cover) of the jack, which is this invention's embodiment. As shown in FIG. 5, the contact insertion opening 7 that is formed in the housing 1 is closed by a cover 42, having sliding protrusions 43 formed on its respective side edges. These sliding protrusions 43 are also formed on the opposing faces of a slit 44, provided in the front end of the cover 42.

Figure 8:
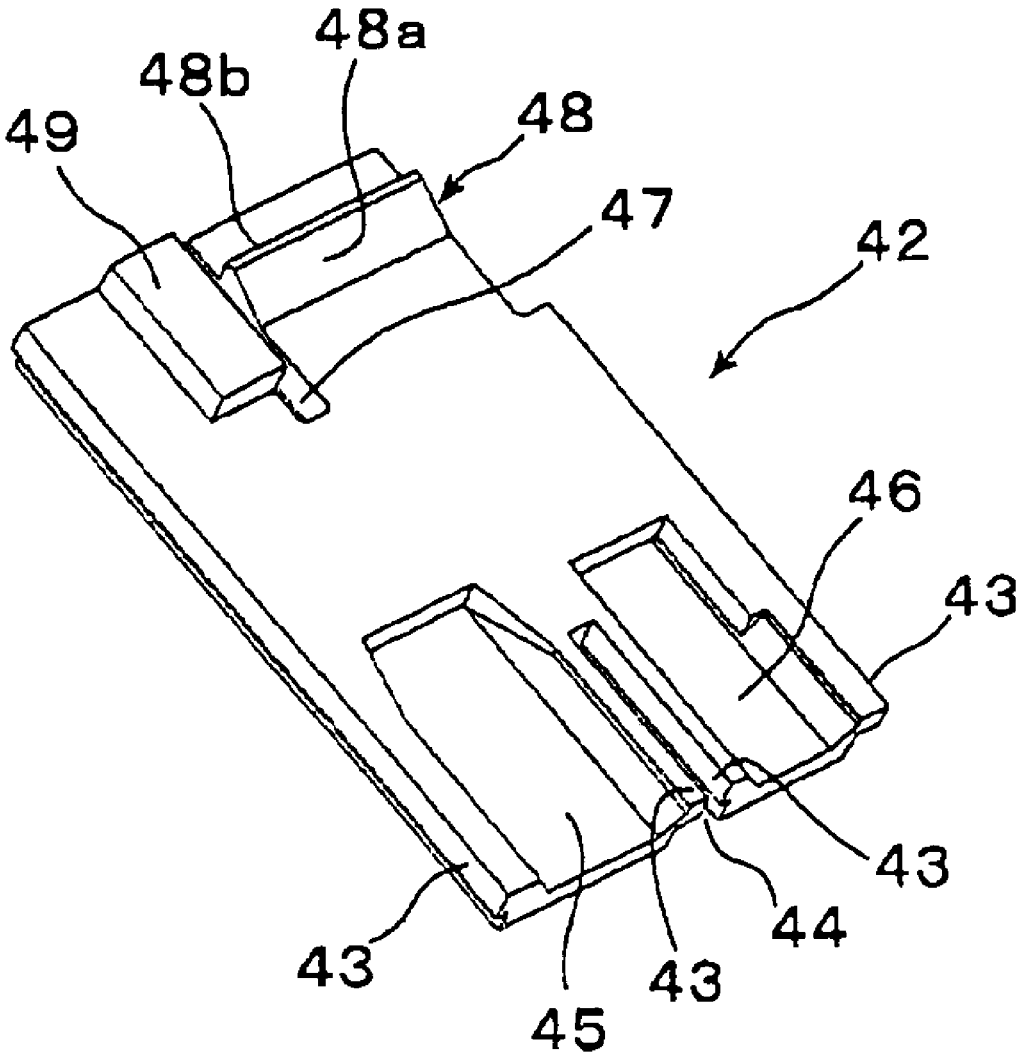
FIG. 8 is a perspective view of the cover of FIG. 5 as seen from the back side.

FIG. 8 is a perspective external view of the cover of FIG. 5 as seen from the back side. As shown in FIG. 8, at the respective sides of the slit 44, recessed parts 45 and 46 for avoiding interference are formed at positions of the back side of the cover 42 corresponding to the lead wire insertion parts that are in communication with the respective crimp part housing parts. Furthermore, a slit 47 is formed at the rear end of the cover 42, and at the respective sides of this slit 47, a wedge-like raised part 48 and a raised part 49 are disposed on the rear side of the cover 42.

As shown in FIG. 5, to attach the cover 42 to the housing 1, the sliding protrusions 43 are engaged with the guide groove 36 and the cover 42 is slid in the direction of the arrow in the figure. When the front end of the cover 42 reaches the stopper 37, the sliding protrusions 43 of the slit 44 engage with the guide grooves 36 of the stopper 37.

Thereafter, an inclined face of the wedge-like raised part 48 rides on top of the raised part 38 and a vertical face 48*b* (see FIG. 8) of the wedge-like raised part engages with the raised part 38 (see FIG. 1), the silt 44 contacts the stopper 37, and the sliding of the cover 42 is stopped by the stopper 37 and the raised part 38 (see FIG. 1).

A method of assembling this power supply jack shall now be described. The respective crimp parts 3*c* and 4*b* of the two types of contacts 3 and 4 are crimped and connected with the lead wires 51 and 52.

FIG. 1 is a perspective view illustrating an assembly procedure (insertion of the contact) of the jack, which is this invention's embodiment. As shown in FIG. 1, the crimp part 4*b* is housed in the crimp part housing part 13 by inserting the main contact body 4*a* of the J-shaped contact 4 through the second opening 15 and fixing it in the second insertion chamber 10 (see FIG. 13), and the lead wire 52 is lead out of the housing 1 from the lead wire insertion part 41.

FIG. 2 is a perspective view illustrating an assembly procedure (insertion of the hollow columnar contact) of the jack, which is this invention's embodiment. Next, as shown in FIG. 2, the cylindrical main contact body 3*a* is inserted through the first opening 14 and held in the first insertion chamber 9 (see FIG. 13).

Figure 3:
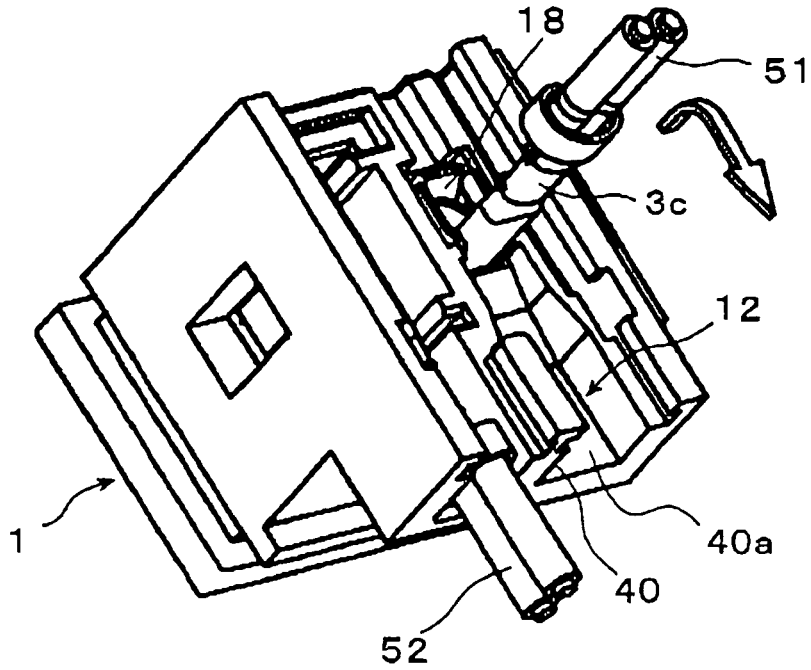
FIG. 3 is a perspective view illustrating an assembly procedure (bending of the vicinity of a base part of a contact) of the jack, which is this invention's embodiment.

FIG. 3 is a perspective view illustrating an assembly procedure (bending of the vicinity of the base part of the contact) of the jack, which is this invention's embodiment. As shown in FIG. 13, by bending and housing the crimp part 3*c* in the crimp part housing part 12, the lead wire 51 is taken out to the exterior of the housing 1 from the lead wire insertion part 40.

Figure 4:
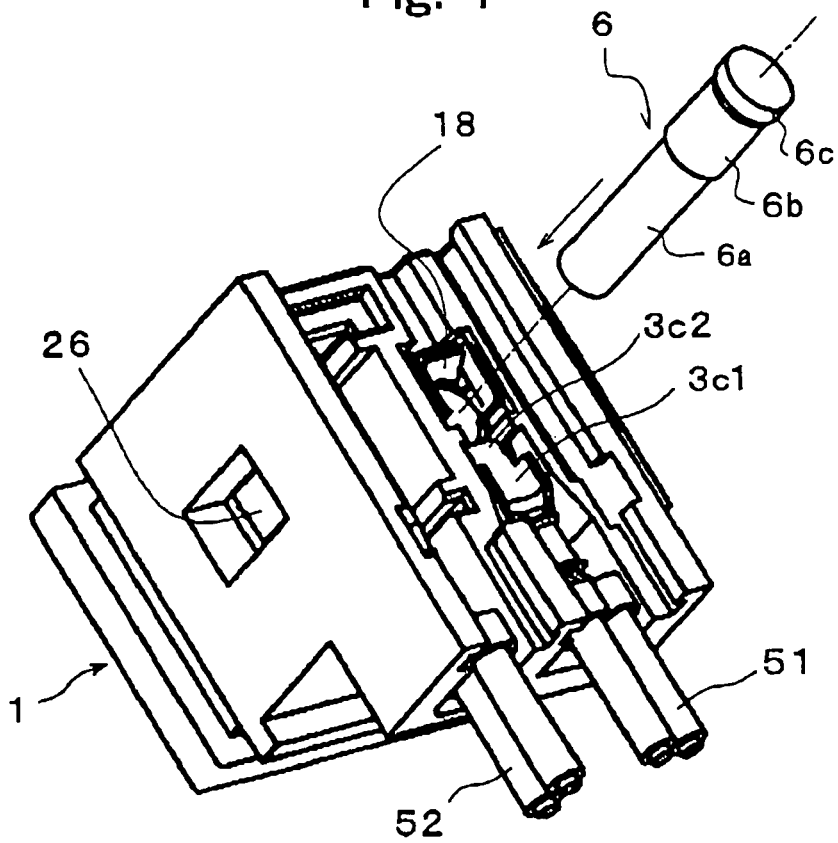
FIG. 4 is a perspective view illustrating an assembly procedure (housing of a crimp part) of the jack, which is this invention's embodiment.

FIG. 4 is a perspective view illustrating an assembly procedure (housing of the crimp part) of the jack, which is this invention's embodiment. As shown in FIG. 4, a press fit pin 6 is press-fitted into the cylindrical main contact body 3*a* (see FIG. 2) and the contact 3 is thereby held firmly in the housing 1. FIG. 5 is a perspective view illustrating an assembly procedure (engagement of the cover) of the jack, which is this invention's embodiment. Lastly as shown in FIG. 5, the cover 42 is mounted to the contact insertion opening 7 of the housing 1.

The present embodiment shall now be described in detail with reference to the respective drawings.

FIG. 1 shows the manner in which the contact (J-shaped contact) 4, having an elastic movable contact and a J-shaped cross-section, is about to be mounted to the housing 1 of this embodiment's jack by insertion in the opening (contact insertion opening) for insertion into the interior, which is positioned at the back face 1*b* of the housing 1.

Figure 7:
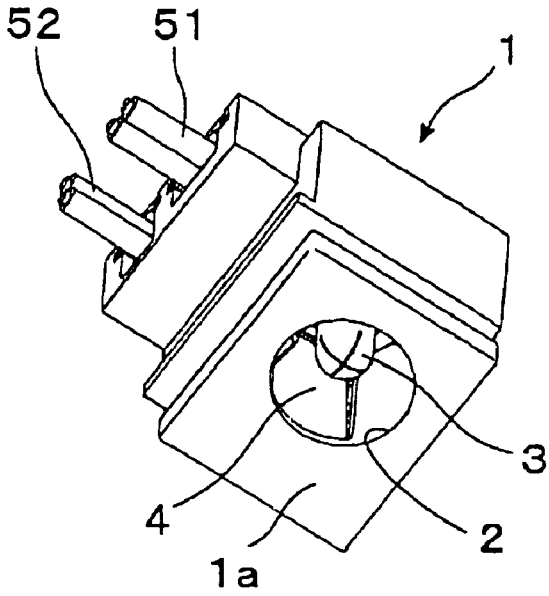
FIG. 7 is a perspective view of the jack of FIG. 6 as seen from the front side.

The housing 1 has a rectangular box-like shape as a whole, and is surrounded by the back face 1*b*, which can be seen at the upper right in the figure, the four side faces contacting the four edges of the back face 1*b*, and a front face 1*a*, which cannot be seen due to facing towards the lower left in FIG. 1 but can be seen as facing downwards in FIG. 7. Of the four side faces, with a first side face that can be seen towards the front in FIG. 1, a window 27 is provided at a substantially central part and the thin, small piece (or lance) 26 is positioned inside this window.

At a second side face, adjacent the first side face and being faced downward in the figure, a rectangular raised part 60, which protrudes from this second side face, is formed at the side of the back face 1*b* of the housing 1, and two, substantially rectangular openings are provided at the second side face side of the raised part 60.

These two substantially rectangular openings are the lead wire insertion openings 40*a* and 41*a*, and the lead wire insertion parts 40 and 41, in communication with the respective openings, are disposed in the raised part 60.

These lead wire insertion parts 40 and 41 open in the direction of the back face of the housing 1, and when viewed from the side of the above-mentioned second side face, the above-mentioned raised part has a W-shape or the shape of an E that is set on its side. The guide grooves 3B, along which the cover 42, to be described below, is slid, are formed in a recessed manner in the three open front end parts of the E-shaped member.

The guide grooves 36 are an embodiment of the above-mentioned guide member and are formed substantially parallel to the back face 1*b* of the housing 1. Protruding parts 17, at the upper sides of the guide groove 36, form the walls at one side of the guide grooves 36 and have the function of holding the below-described cover 42 so that it does not become separated from the housing 1 when the cover 42 is slid along the guide grooves 36.

The middle front end part 37, among the three open front end parts formed in the E-like shape described above, functions as a stopper when the below-described cover 42 is slid and made to cover the openings at the back face 1*b* of the housing 1.

The front end part 37, which functions as a stopper, is formed above the partition wall 11 that partitions the respective crimp part housing passages in communication with the above-mentioned two lead wire insertion parts 40 and 41.

Figure 12:
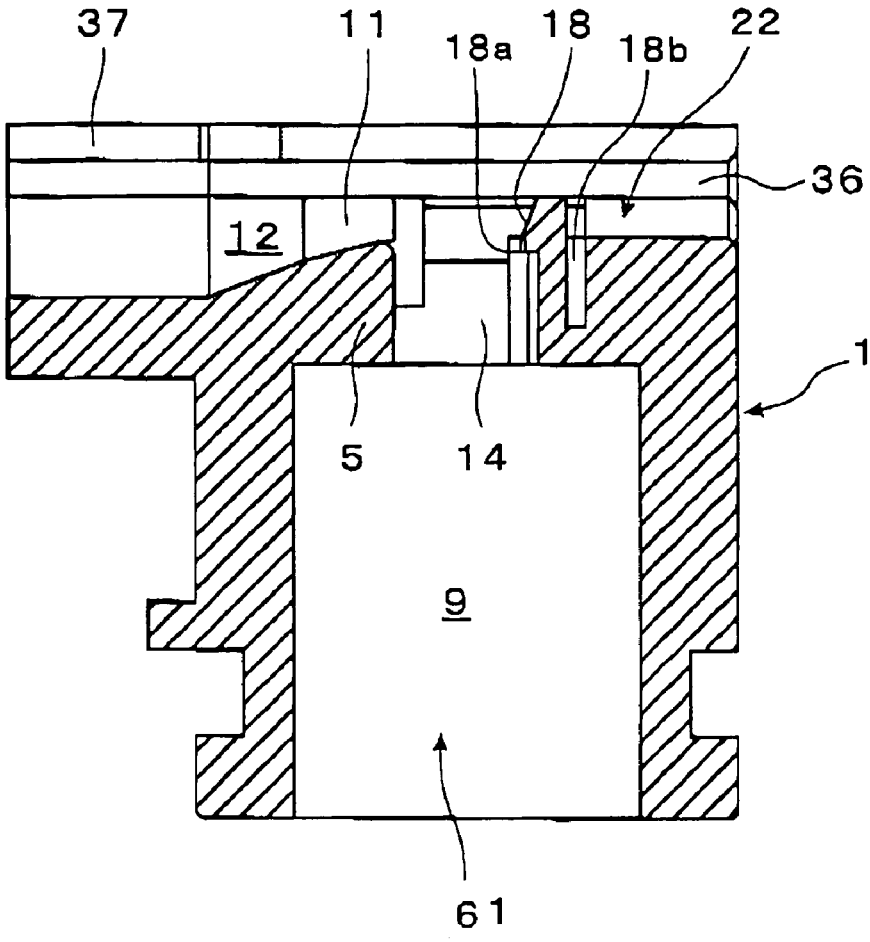
FIG. 12 is a sectional view taken along arrows A—A of FIG. 11.

In FIG. 1, upward from the lead wire insertion opening 40*a* and past the lead wire insertion part 40 and the recessed part, that is, the crimp part housing part (or the first crimp part housing passage) 12, which houses the crimp part 3*c* (see FIG. 2) of the hollow columnar contact 3 that is the above-mentioned first crimp part, is formed the space (or the member extension part), which houses the member that extends from the base part of the hollow columnar contact 3 to the first crimp part, and further upward is formed the first opening 14, in which the hollow columnar contact 3 is inserted (see FIG. 12).

The first crimp part housing passage 12 and the member extension part are made shallow in depth in accompaniment with the rising of the back face 1*b* side of the partition wall 5 that defines the bottom parts of these components.

In the first opening 14, the so-called lance 18, which is an embodiment of the third latching part, is disposed at a position of the periphery of a column insertion opening 14*a* (see FIG. 13) that opposes the above-mentioned member extension part. The lance 18 is the member, with which, in FIG. 1, the longitudinal sectional shape is like a sideways T with the stem inclined downwards or upwards, with the back face 1*b* side of the housing 1 being the upper side, and with which the transverse sectional shape is rectangular.

The pair of slits 191 and 192 (see FIG. 13) are disposed at the respective sides of the lance 18 and the lance 18 can be tilted forward and backward by making use of the elasticity of the member by which the lance 18 is continuously connected at its lower part to the housing 1. In order to adjust the force necessary for such movement, a slit 18*b* (see FIG. 12) is provided on the back face of lance 18 and the cross-sectional area, etc., of the continuously connected member is adjusted thereby.

The slit 18*b*, which is illustrated most clearly in FIG. 12, can provide, by means of its width, a degree of freedom for making the lance 18 move when the lance 18 is pushed backward (towards the back face side). Thus, when the cylindrical main contact body 3*a* (see FIG. 2) is inserted in the column insertion opening 14*a* (see FIG. 13), the locking mechanism based on the lance 18 can be made to function without giving rise to excessive resistance.

Also, as illustrated most clearly in FIG. 11, near the tip of the stem of the "sideways T" of the lance 18, a portion, which is somewhat gouged in arcuate manner so as to match the column insertion opening 14*a* (see FIG. 13), is provided to enable the cylindrical main contact body 3*a* (see FIG. 2) to be inserted smoothly.

As shown in FIG. 1, the raised part 38 is formed near the side face of the housing 1 at the side opposite the lead wire insertion openings 40*a* and 41*a* and this forms a locking mechanism that engages with the wedge-like raised part 48 of the cover 42, which shall be described later.

As shown in FIG. 1, the second opening 15, which is included in the contact insertion opening 7 (see FIG. 5), is opened to enable insertion of the J-shaped contact 4, having a cross-sectional shape that appears J-like, into the second insertion chamber 10 (see FIG. 13). The J-shaped contact 4 is arranged from the main contact body 4*a* and the second crimp part 4*b* for holding the dedicated lead wire 52.

As shall be described in detail later, the main contact body 4*a* includes a rectangular back face plate 4*c* and a pair of guide plates 4*d*1 and 4*d*2, disposed at the respective sides of the rectangular back face plate 4*c*. At substantially the center of the rectangular back face plate 4*c* is provided the member (or lance) 4*f*, which is raised in a wedge-like manner, is an embodiment of the above-described wedge-like raised member, and can become engaged with the small piece 26.

FIG. 2 is a perspective view illustrating an assembly procedure (insertion of the hollow columnar contact) of the jack, which is this invention's embodiment. In FIG. 2, after the J-shaped contact 4, shown in FIG. 1, is inserted in the second insertion chamber 10 (see FIG. 13) of the housing 1 and fixed at the predetermined position of the housing 1, the hollow columnar contact 3 is inserted inside the housing 1 from the first opening 14, which serves as the contact insertion opening.

In FIG. 2, the hollow columnar contact 3 is arranged from the cylindrical main contact body 3*a*, the pair of L-shaped tongues 3*b*1 and 3*b*2, and the first crimp part 3*c*, onto which the dedicated lead wire 51 is crimped. The first crimp part 3*c* may include an insulation grip 31*c*, by which the lead wire 51 is crimped from above the cladding material, and a conductor grip 32*c*, by which the core material of the lead wire 51 is crimped.

Prior to the insertion of the hollow columnar contact 3 into the first opening 14, the respective members mentioned above of the hollow columnar contact 3 are aligned in a straight line along the columnar axis as shown in FIG. 2.

The front end (with respect to the direction of insertion indicated by the arrow) of the hollow columnar contact 3 is directed towards the lower left in the figure and may be closed by the same method as that used for preparing the hollow, cylindrical main contact body 3*a* from a metal plate.

In the present embodiment, the front end of the main contact body 3*a* is made spherical due to the specification of the jack and for the reason of appearance, etc. As can be understood from FIG. 2, the hollow columnar contact 3 is inserted through the first opening 14 into the column insertion opening 14*a* (see FIG. 13) with the pair of L-shaped tongues 3*b*1 and 3*b*2 being oriented towards the upper left in the figure so as to be fitted into the slits 191 and 192 (see FIG. 11) at the respective sides of the lance 18.

FIG. 3 is a perspective view illustrating an assembly procedure (bending of the vicinity of the base part of the contact) of the jack, which is this invention's embodiment. FIG. 3 shows the state in which the hollow columnar contact 3 is inserted through the first opening 14 (see FIG. 2) into the column insertion opening 14*a* (see FIG. 13) and fixed at the predetermined position.

The end parts at the front end side of the columnar axis of the pair of L-shaped tongues 3*b*1 and 3*b*2 (that is, with respect to the L-shape, the end parts at the inner corner side of the L at the horizontal bar of the L) contact the pair of steps 201 and 202 (see FIG. 13) disposed in the pair of slits 191 and 192, respectively, and further progress in the insertion direction of the pair of L-shaped tongues 3*b*1 and 3*b*2 (see FIG. 2) is thereby prevented. Progress in the insertion direction of the hollow columnar contact 3 is thus stopped.

Here, the pair of steps 201 and 202 are flat parts formed inside the pair of slits 191 and 192 and are disposed at the outer sides of the pair of slits 191 and 192 with respect to the cylindrical main contact body 3*a* (see FIG. 11 and FIG. 13). Also, at this time, since the nose tip part 18*a* (see FIG. 12) of the lance 18, which was pushed outwards by the cylindrical main contact body 3*a*, is moved past the engaging base part at the base end part of the cylindrical main contact body 3*a*, it returns by its elastic repulsive force to the inner side of the column insertion opening 14*a* (see FIG. 13) and engages with the engaging base part to prevent the falling-off of the columnar contact 3.

Though the latching part (which may be included in the third latching part) 18*a*, which is the nose tip part of the lance 18 shown in FIG. 12, engages with the engaging base part at a single location, since the column insertion opening 14*a* (see FIG. 13) is not very large in clearance with respect to the hollow, cylindrical main contact body 3*a*, the above-mentioned engagement cannot be disengaged readily by the tilting of the cylindrical main contact body 3*a* with respect to the columnar axis. The column insertion opening 14*a* (see FIG. 13) thus restricts the movement of the cylindrical main contact body 3*a* towards the lower right in FIG. 3.

The hollow columnar contact 3, which is fixed to the predetermined position of the first insertion chamber 9 (see FIG. 13) of the housing 1 in FIG. 3, is bent in the direction of the arrow in the figure (direction of sliding and closing by the cover 42 to be described below) so that its first crimp part 3*c* (see FIG. 2) is housed in the crimp part housing passage 12 and the lead wire 51 is housed in the lead wire insertion part 40 from the crimped side to the lead wire insertion opening 40*a*.

FIG. 4 is a perspective view illustrating an assembly procedure (housing of the crimp part) of the jack, which is this invention's embodiment. FIG. 4 illustrates the state in which the hollow columnar contact 3 has been bent and is housed in a recessed part of the housing 1. The portion of the hollow columnar contact 3 that corresponds to the above-mentioned column connecting base part is the portion positioned between the first crimp part 3*c* and the base part of the cylindrical main contact body 3*a*.

More specifically, the column connecting base part is arranged from a ribbed extension part 3*c*1 and a rib-less extension part 3*c*2 shown in FIG. 4. By the provision of the ribs, the ribbed extension part 3*c*1 is increased correspondingly in resistance against bending and 1*a* housed in a substantially straight state in the crimp part housing passage 12.

Meanwhile, since the rib-less extension part 3*c*2 is without ribs and is disposed near the corner parts of the partition wall 5 (see FIG. 12), it bends readily. The bending part can thus be prevented from spreading and curving more than necessary such that it cannot be kept housed in the recessed part of the housing 1. The corner parts of the partition wall 5 are made sharp corners in consideration of the spring-back in the bending process.

In FIG. 4, the press-fit pin 6 is press-fitted into the cylindrical main contact body 3*a* (see FIG. 2) that has been inserted into the first opening 14 (see FIG. 2). The press-fit pin 6 is arranged with a small-diameter axial part 6*a*, a large-diameter axial part 6*b*, and a head part 6*c*. The actions of the press-fit pin 6 shall be described in detail later.

FIG. 5 is a perspective view illustrating an assembly procedure (engagement of the cover) of the jack, which is this invention's embodiment. After the J-shaped contact 4 (see FIG. 1) and the hollow columnar contact 3 (see FIG. 2) have been inserted in the housing 1 and the respective crimp parts 4*b* and 3*c*, etc., of the above-mentioned contacts have been housed in the corresponding recessed parts at the back face 1*b* side of the housing 1, the cover 42 is slid on to cover the opening 7 of the back face 1*b*.

As shown in FIG. 5, the cover 42 is plate-like member with a substantially rectangular shape, and is equipped with a slit 44, which is of predetermined length and is substantially parallel to the sliding direction, at the front end side of the cover 42 with respect to the sliding direction indicated by the arrow in the figure.

As shown in FIG. 5, at the respective end parts that define the slit 44 are provided the same sliding protrusions 43 that are provided at the respective side faces of the cover 42. The sliding protrusions 43 are fitted in the guide grooves 36 of the housing 1 to enable the cover 42 to be slid along the guide grooves 36.

The cover 42 has the slit 47 at its rear part and a thin part 50 is enabled to deform independently of the portion adjacent to the right, on the surface of which is formed an arrow. The wedge-like raised part 48 is formed on the back face of the thin part 50. This wedge-like raised part 48 forms the locking mechanism of the cover 42 along with the raised part 38 of the housing 1.

First, the sliding protrusions 43 at the respective sides of the front end part of the cover 42 are fitted into the guide grooves 36 at the respective sides of the housing 1. At this point, since the protruding parts 17 that form the guide grooves 36 are positioned at the upper side (or the back face side) of the sliding protrusions 43 and restrict upward movement of the cover 42, even while the cover 42 is being slid so as to cover the contact insertion opening 7, the cover 42 is prevented from becoming removed from the guide grooves 36 and the cover 42 is thereby prevented from becoming detached from the housing 1.

After the front end of the cover 42 is engaged at its sliding protrusions 43 with the guide grooves 36, the cover 42 is pushed as straightly as possible in the sliding direction indicated by the arrow. When the front end of the cover 42 reaches the final part of the stopper 37 of the housing 1 in regard to the sliding direction, engagement of the sliding protrusions 43 at the alit 44 of the cover 42 with the guide grooves 36 at the stopper 37 begins and the relationship between these components become the same as the relationship between the sliding protrusions 43 and the guide grooves 36 at the respective sides.

Since the protruding parts 17 that form the guide grooves 36 at the stopper 37 are positioned near the lead wire insertion part, the detachment of the cover 42 in the upward direction is made even less likely to occur.

Figure 6:
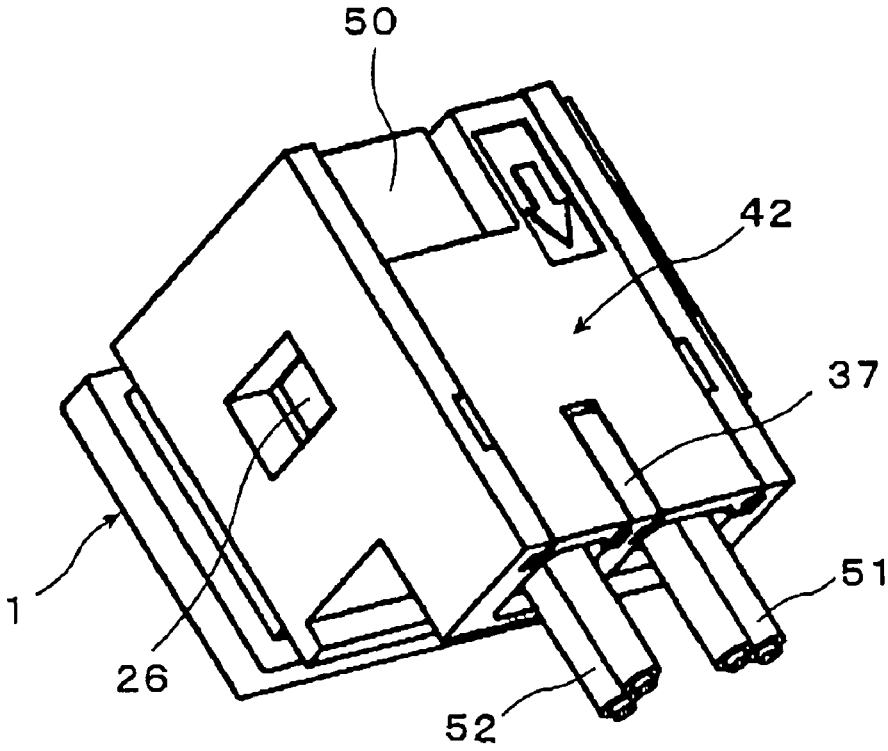
FIG. 6 is a perspective view illustrating an assembly procedure (completion of assembly) of the jack, which is this invention's embodiment.

FIG. 6 is a perspective view illustrating an assembly procedure (completion of assembly) of the jack, which is this invention's embodiment. In FIG. 6, when the lead wires 51 and 52 are pulled in the upward direction in the figure, an upward pulling force acts on the cover 42 at the lead wire insertion openings 40*a* and 40*b* (see FIG. 1). The structure of reinforcement by such guide grooves 36 (see FIG. 5), etc., in the stopper 37 is thus extremely favorable.

Returning now to FIG. 5, when the sliding of the cover 42 proceeds slightly, an inclined face 48*a* of the wedge-like raised part 48 (see FIG. 8) begins to contact the raised part 38 (see FIG. 1) of the housing 1. Since the inclined face 48*a* of the wedge-like raised part 48 has a shape with which the rise increases gradually from the front end to the tall end, though the resistance against the sliding of the cover 42 increases somewhat, there is no sudden change and the sliding can be performed until the contact insertion opening 7 is closed. The resistance in this process can be adjusted to an optimal resistance by adjusting the thickness and length of the thin part 50.

When the cover 42 is closed, the wedge-like raised part 48 passes over the raised part 38 of the housing 1 and fits into the recessed part at the front due to the elastic repulsive force of the thin part 50. Opening of the opening part due to the sliding of the cover 42 rearward is thus made difficult. This is because the vertical face 48*b* of the wedge-like raised part 48 and the raised part 38 contact each other at vertical surfaces.

The stopper 37 stops the progress of the cover 42 in the sliding direction by coming in contact with the final part of the slit 44. The cover 42 is stopped in movement and fixed in position by being sandwiched by the stopper 37 and the raised part 38 and being sandwiched by the protruding parts 17 and the guide grooves 36.

FIG. 6 shows the state in which the contact insertion opening 7 is closed by the above. The jack that is thus completed has an extremely compact shape. The groove that is provided so as to go around the side faces near the front surface side of the housing 1 can be used for mounting onto the frame or body of an equipment that uses this jack. The jack can thus be fixed without applying a mechanical force to the electrical connection parts of the jack.

FIG. 7 is a perspective view of the jack as viewed from the front side. FIG. 7 shows the completed jack as viewed from below. A circular opening 2, which is opened at substantially the center of the front surface 1*a* of the housing 1, is a hole for inserting a plug or other external terminal to be connected to the jack. The front end part of the hollow columnar contact 3 is visible from the opening 2. The elastic movable contact of the J-shaped contact 4 is also visible from the opening 2.

These two contacts may be used in positive/negative or positive/ground relationship with respect to each other. The lack of the present invention can be assembled and disassembled any time, and for disassembly, the respective locking mechanisms are released and the respective parts are moved in manners reverse the movements described above.

FIG. 8 is a perspective view of the cover of FIG. 5 as viewed from the back side. FIG. 8 shows the back side of the cover 42 in more detail. At the front end of the cover 42 is the slit 44, and at the end parts of the cover 42 that define the slit 44, the sliding protrusions 43 are formed in the same manner as the sliding protrusions at the side end parts of the cover 42.

In FIG. 8, the recessed part 46 at the right side of the figure corresponds to being the lid portion for the crimp part housing part and the lead wire insertion part, which, when the housing 1 is covered by the cover 42, house the second crimp part 4*b* (see FIG. 1) and the crimped lead wire of the J-shaped contact 4.

Also, in FIG. 8, the recessed part 45 at the left side of the figure corresponds to being the lid portion for the crimp part housing part and the lead wire insertion part, which house the first crimp part 3*c* (see FIG. 2) and the crimped lead wire of the hollow columnar contact 3.

These recessed parts 45 and 46 can thus make the above-mentioned housing spaces larger. At the rear side of the cover 42 is provided the slit 47 and adjacent to the right thereof are provided the wedge-like ridge part 48, the gradually inclined face 48*a* thereof, and the vertical face 48*b*, formed like an abruptly erected wall, and by these is arranged a part of the locking mechanism of the cover 42.

Adjacent to the left of the slit 47 is positioned the raised part 49, and this raised part 49 contacts or approaches the back face of the lance 18 considerably closely and restricts the lance 18 from moving in the direction in which the hollow columnar contact 3 becomes removed.

FIG. 9 is a perspective view of the housing as viewed from the back side and shows the respective members of the housing 1 in detail. In FIG. 9, the guide grooves 36 are provided at upper parts of the respective side walls of the housing 1 below the protruding parts 17, are also provided at upper parts of the stopper 37 at the center of the face faced towards the front, and combine with the sliding protrusions 43 at the respective side end faces, etc., of the cover 42, shown in FIG. 8, to arrange a closing mechanism for the slide type contact insertion opening 7.

At the part of the contact insertion opening 7 to the front of the second opening 15, into which the J-shaped contact 4 is inserted, is provided the crimp part housing part 13, which houses the crimp part 4*b* of the J-shaped contact 4, and further to the front thereof is provided the lead wire insertion part 41, and when viewing the face faced towards the front of the raised part 60 at the face faced towards the front, the lead wire 52 (see FIG. 1), which is connected by crimping to the J-shaped contact 4, is extended out from the lead wire insertion opening 41*a*, which, in a side view of the W-like or tilted E-like shape, is the opening at the left side.

The first opening 14, which is adjacent to the right in FIG. 9, has the lead wire insertion opening 40*a*, from which extends out the lead wire 51 that is connected by crimping to the hollow columnar contact 3, and this continues to the lead wire insertion part 40 at the inner side and to the first crimp part housing part 12 further at the inner side.

In FIG. 9, the stopper 37 is provided above the partition wall 11, which partitions the first crimp part 3*c* and the second crimp part 4*b*. In regard to this partition wall 11, since the upper face of the stopper 37 and the upper face of the cover 42 are flush with respect to each other, the partition wall 11 without any openings in the partition wall can provide secure electrical partitioning of the contacts 3 and 4.

FIG. 10 is a perspective view of the J-shaped contact. The structure of the J-shaped contact 4 shall now be described with reference to FIG. 10 and the procedures for inserting the J-shaped contact 4 shall be described with reference to FIG. 1 and FIG. 9. As described above, the J-shaped contact 4 is arranged from the main contact body 4*a* and the crimp part 4*b*, to which the lead wire 52 is connected by crimping, and the main contact body 4*a* has the rectangular back face plate 4*c* and the pair of guide plates 4*d*1 and 4*d*2, which are bent forward in a substantially right angle from the respective sides of the rectangular back face plate 4*c*, and the elastic movable contact 4*e*, which is enabled to have a contact pressure that is secured by the elastic force that arises at the lower bent part at the bottom of the J-shape, is positioned at a position surrounded at both sides by the guide plates 4*d*1 and 4*d*2 at the front side of the rectangular back face plate 4*c*.

This elastic movable contact 4*e* furthermore has, at the folded front end portion thereof, a front end fold member, which extends in the width direction and with which the respective ends are constrained by the openings 4*g*1 and 492 of the guide plates 4*d*1 and 4*d*2 at the respective sides. Due to this restriction, by the openings 4*g*1 and 4*g*2, of the movement of the front end fold member extending in the width direction, the elastic deformation amount, etc., of the elastic movable contact 4*e* is restricted to be within the size of the openings 4*g*1 and 4*g*2.

Notches are formed in the respective sides of the front end side (or lower side) of the rectangular back face plate 4*c* in FIG. 10, and the lengths of the connecting pieces between the guide plates 4*d*1 and 4*d*2 at both sides and the rectangular back face plate 4*c* are made somewhat narrow thereby. This is carried out in order to suitably adjust the elastic force at the above-mentioned lower bent part, and the portions at the foremost ends of the guide plates 4*d*1 and 4*d*2 (the front end edges, which are somewhat chamfered but form substantially right angles with respect to the rectangular back face plate 4*c*) protrude below or to the front end of the lower bent part.

Thus, when this J-shaped contact 4 is made to proceed in its insertion direction, since the shape of the bottom part of the second insertion chamber 10 (see FIG. 13) is flat, the front edges contact this flat bottom part ("lower flat face") 10*a* before the lower bent part.

Meanwhile, as shown in FIG. 9, the lance 18 engages at its nose tip part 18*a* (see FIG. 12) with the engaging base part of the hollow columnar contact 3 that has been inserted as described above to prevent the falling-off of the hollow columnar contact 3 and resists the pressing force when a plug, etc., (not shown) is connected to the jack.

The nose tip part 18*a* that is shown in FIG. 12 may be included in an embodiment as the above-described third latching part. When the cover 42 is slid, the raised part 49 (see FIG. 8) at the lower surface of the cover 42 approaches the recessed part 22, shown in FIG. 9, and functions to oppose the deformation towards the back surface of the lance 18.

FIG. 11 is a plan view of FIG. 9, and the pair of steps 301 and 202, shown in FIG. 11 contact the front ends of the pair of L-shaped tongues 3*b*1 and 3*b*2 (see FIG. 2) and stop the progress of insertion of the hollow columnar contact 3. The protruding parts 17 form the guide grooves 36 (see FIG. 9) and have the function of restraining the sliding protrusions 43 (see FIG. 43) of the cover 42 at the upper side and thereby preventing detachment from the housing 1.

FIG. 11 is a plan view of the housing 1 as viewed from its back face 1*b*. The respective components are as have been described above. For a clearer view of the internal structure of the housing 1, the sectional view taken along the arrows A—A is shown in FIG. 12, the sectional view taken along the arrows B—B is shown in FIG. 13, and the sectional view taken along the arrows C—C is shown in FIG. 14, In FIG. 11, the arcuate shape positioned ahead of the second opening 15 is the edge of the opening 2 that is opened in the front surface la of the housing 1. FIG. 12 is the section of the first opening 14 as sectioned in the direction of sliding of the cover 42 and viewed towards the second opening 15 side.

In FIG. 13, the first insertion chamber 9 is in communication with the second insertion chamber 10 via this rectangular opening portion, and above it is positioned the column insertion opening 14*a*, having a comparatively narrow clearance with respect to the cylindrical main contact body 3*a* of the hollow columnar contact 3.

In FIG. 12, the lance 18 has the nose tip part 19*a*, which, upon engagement, restricts the upward movement of the cylindrical main contact body 3*a* (see FIG. 2), and is adjusted in the resistance against deformation in the back direction by the slit 18*b* (see FIG. 12) at the back. FIG. 13 is the section passing through the center of the column insertion opening 14*a*, perpendicular to the sliding direction of the cover 42, and viewed from the front end part to the rear tail side in the sliding direction.

In FIG. 13, the contact insertion opening 7 is positioned at a space sandwiched by the protruding parts 17 at both sides. The positions of the pair of steps 201 and 202 that contact the pair of tongues 3*b*1 and 3*b*2 (see FIG. 2) can be understood clearly in terms of height. The first insertion chamber 9 and the second insertion chamber 10 communicate with each other at the portion (plug connection opening 61) without the partition wall 8, and with the jack in the state in which all of contacts 3 and 4 have been inserted, the elastic movable contact 4*e* of the J-shaped contact 4 protrudes from the opening of communication into the first insertion chamber. The other pole of a plug, into the interior of which the cylindrical main contact body 3*a* has been inserted, is thus made to contact the elastic movable contact 4*e* to enable transmission of electrical energy, etc.

In FIG. 9, a semicircle 18 drawn in the nose tip part 18*a* of the lance 18 since this portion slightly carved in order to make the cylindrical main contact body 3*a* (see FIG. 2) be inserted more readily. FIG. 14 is a section of the second insertion chamber sectioned in the direction of sliding of the cover 42 as viewed towards the first insertion chamber 9 side (see FIG. 13). As mentioned above, the plug connection opening 61 is opened at a portion without the partition wall 8 to provide the function as a jack.

Figure 15:
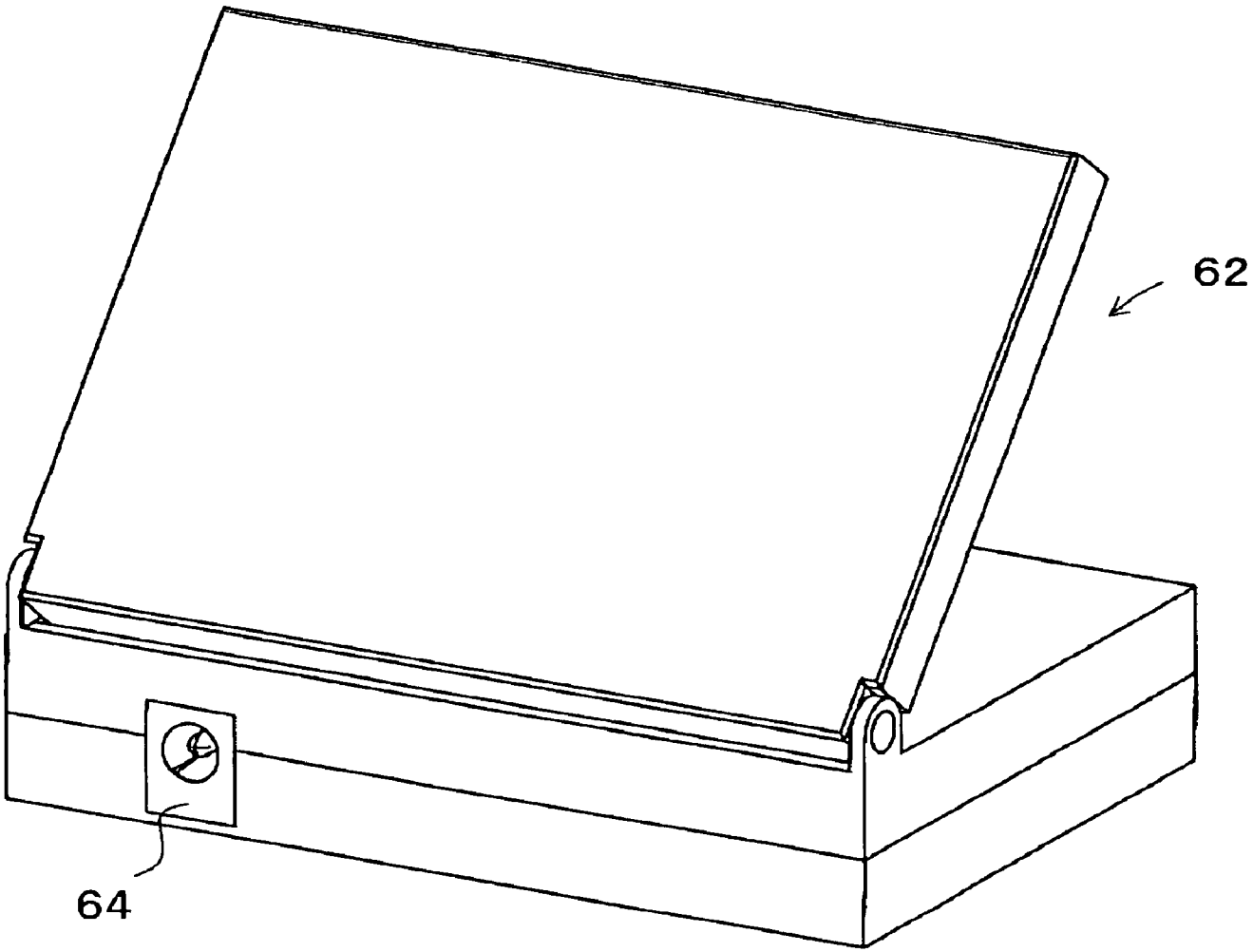
FIG. 15 is a perspective showing an electrical equipment to which a jack that is an embodiment of this invention is applied.

FIG. 15 shows an example wherein a jack 64, which is an embodiment of this invention, is applied to a notebook computer 62. This jack 64 is a power supply jack for the notebook computer 62. The cross, which is a characteristic pattern on the front end of the hollow columnar contact, is visible from the opening for plug connection. This invention's jack can be applied not only to such notebook personal computers but to various other electrical equipments as well. Also, the scope of application is not limited to power supplies and applications to various types of jacks for taking out and receiving electrical signals are possible.

Figure 16A:
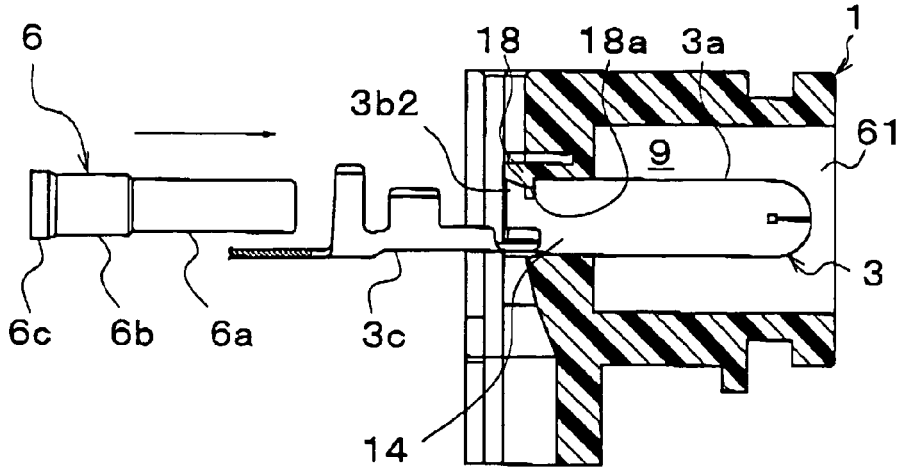
FIGS. 16A to E are Longitudinal sectional views of the jack by this invention.

The actions of the press-fit pin 6 shown in FIG. 4 shall now be described with reference to FIGS. 16A to E. FIG. 16A is a longitudinal sectional view of the jack by this invention. FIG. 16A corresponds to FIG. 17A of the prior art. The housing 1 shown in FIG. 16A is the same as that of the sectional view of FIG. 12.

As was also described using FIG. 4, the press-fit pin 6 is press-fitted inside the cylindrical main contact body 3*a*, inserted in the first opening 14 (see FIG. 2), as shown in FIG. 18A. Though the state prior to the crimping of the lead wire 51 (see FIG. 2) onto the crimp part 3*c* of the hollow columnar contact 3 is shown in FIG. 16A, the press-fit pin 6 is press-fitted in the state in which the lead wire 51 is crimped onto the crimp part 3*c* as shown in FIG. 4 and the rib-less extension part 3*c*2 is bent.

In FIG. 16A, the press-fit pin 6 is equipped with the small-diameter axial part 6*a*, having an outer diameter smaller than the inner diameter of the cylindrical main contact body 3*a*. Also, the press-fit pin 6 is equipped with the large-diameter axial part 6*b*, having an outer diameter for a "transition fit" fitting with the inner diameter of the cylindrical main contact body 3*a*. in the embodiment, the large-diameter axial part 6*b* is formed to have a standard diameter "2.35" mm within the tolerance of a minimum diameter of "2.34" mm and a maximum diameter of "2.36" mm. Meanwhile, the cylindrical main contact body 3*a* is formed to have a standard diameter "2.35" mm within the tolerance of a minimum diameter of "2.30" mm and a maximum diameter of "2.35" mm.

The press-fit pin 6 is furthermore equipped with the head part 6*c*, having an outer diameter that is larger than the outer diameter of the large-diameter axial part 6*b* and is an outer diameter that pushes and spreads the pair of L-shaped tongues 3*b*1 and 3*b*2. The small-diameter axial part 6*a*, the large-diameter axial part 6*b*, and the head part 6*c* are arranged so as to be matched their respective axial centers.

Figure 16B:
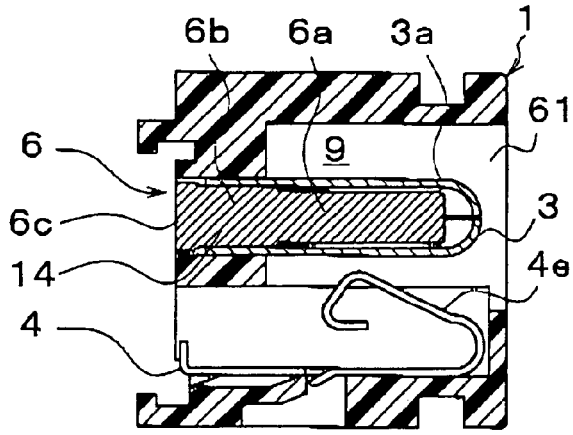

FIG. 16B shows the state in which the press-fit pin 6 has been press-fitted inside the cylindrical main contact body 3*a* as was shown in FIG. 5. The housing 1 shown in FIG. 16B is the same as that of the sectional view shown in FIG. 13.

In the state shown in FIG. 16B, the small-diameter axial part 6*a* provides a gap in the interior of the cylindrical main contact body 3*a*. It is considered that, by there thus being provided a gap in the main contact body 3*a*, not only is the main contact body 3*a* made compressible when a plug is fitted but a heat radiating effect is provided as well.

In the state shown in FIG. 16B, the large-diameter axial part 6*b* is held so as to be in close contact with the interior of the cylindrical main contact body 3*a*. The portion of the large-diameter axial part 6*b* of the press-fit pin 6 corresponds to the portion of the cylindrical main contact body 3*a* that is held by the first opening 14 equipped in the housing 1. By the large-diameter axial part 6*b* being inserted in the root portion of the cylindrical main contact body 3*a* that is otherwise held by a thin cylinder, a rigid axis, which can withstand compression in the direction of the central axis, is realized.

In the state shown in FIG. 16B, the head part 6*c* pushes and spreads the pair of L-shaped tongues 3*b*1 and 3*b*2 and deforms the pair of L-shaped tongues 3*b*1 and 3*b*2. And, as is shown most clearly in FIG. 5, the pair of L-shaped tongues 3*b*1 and 3*b*2 contact the walls at both flanks and firmly hold the root portion of the main contact body 3*a*.

The press-fit pin 6 illustrated in FIGS. 6A to E firmly holds the hollow columnar contact 3 onto the housing 1 and resolves the deflection of the front end of the hollow columnar contact 3. Such a press-fit pin 6 is formed from a hard metal of good conductivity, such as a copper alloy, etc., and may be formed by forging or rolling.

Since this invention's jack is a jack having the hollow columnar contact 3 with which the press-fit pin 6 is press-fitted in the cylindrical main contact body 3*a*, the cylindrical main contact body 3*a* is held firmly onto the housing 1 and the front end of the hollow columnar contact 3 will not deflect. Also, since the visible orientation of the cylindrical main contact body is stable, a user is provided with a sense of security and causes of connection failure can be eliminated.

Figure 16C:
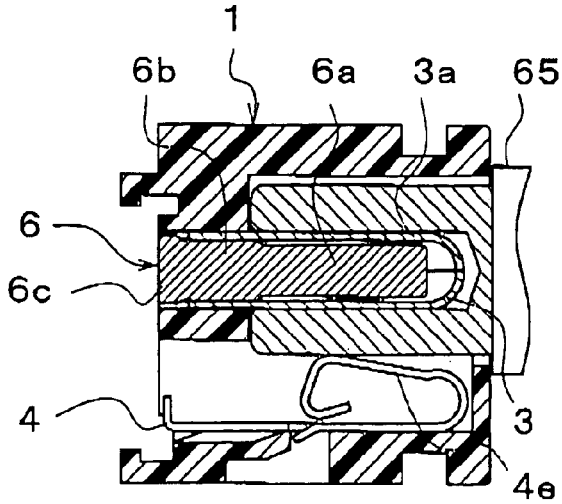

With such a jack, a plug 65 can be inserted readily as shown in the sectional view of FIG. 16C, and the contact 3 will not become detached from the lance 18 (see FIG. 16A) by being pushed in by the plug 65.

Figure 16D:
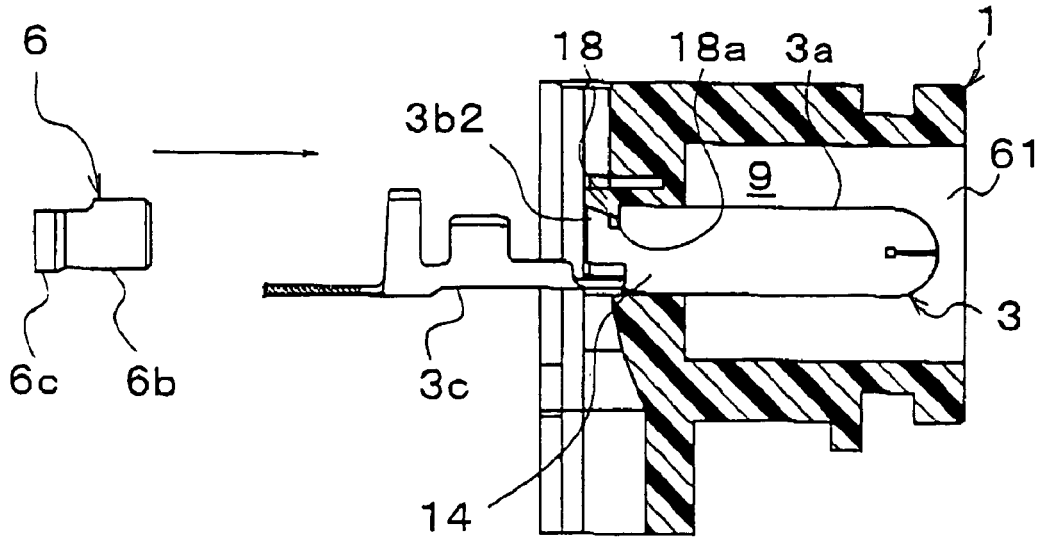

In FIG. 16D, the press-fit pin 6 is press-fitted inside the cylindrical main contact body 3*a*, inserted in the first opening 14 (see FIG. 2), as was shown in FIG. 4. Though the state prior to the crimping of the lead wire 51 (see FIG. 2) onto the crimp part 3*c* of the hollow columnar contact 3 is shown in FIG. 16D, the press-fit pin 6 is press-fitted in the state in which the lead wire 51 is crimped onto the crimp part 3*c* as shown in FIG. 4 and the rib-less extension part 3*c*2 is bent.

In FIG. 16D, the press-fit pin 6 is equipped with the large-diameter axial part 6*b*, having an outer diameter for a "transition fit" fitting with the inner diameter of the cylindrical main contact body 3*a*. With this transition fit, the outer diameter of the pin may be made practically the same or somewhat larger than the inner diameter of the contact. For example, as the embodiment, the large-diameter axial part 6*b* is formed to have a standard diameter "2.35" mm within the tolerance of a minimum diameter of "2.34" mm and a maximum diameter of "2.36" mm. Meanwhile, the cylindrical main contact body 3*a* is formed to have a standard diameter "2.35" mm within the tolerance of a minimum diameter of "2.30" mm and a maximum diameter of "2.35" mm.

The press-fit pin 6 is furthermore equipped with the head part 6*c*, having an outer diameter that is larger than the outer diameter of the large-diameter axial part 6*b* and is an outer diameter that pushes and spreads the pair of L-shaped tongues 3*b*1 and 3*b*2. The small-diameter axial part 6*a*, the large-diameter axial part 6*b*, and the head part 6*c* are arranged so as to be matched in their respective axial centers.

Figure 16E:
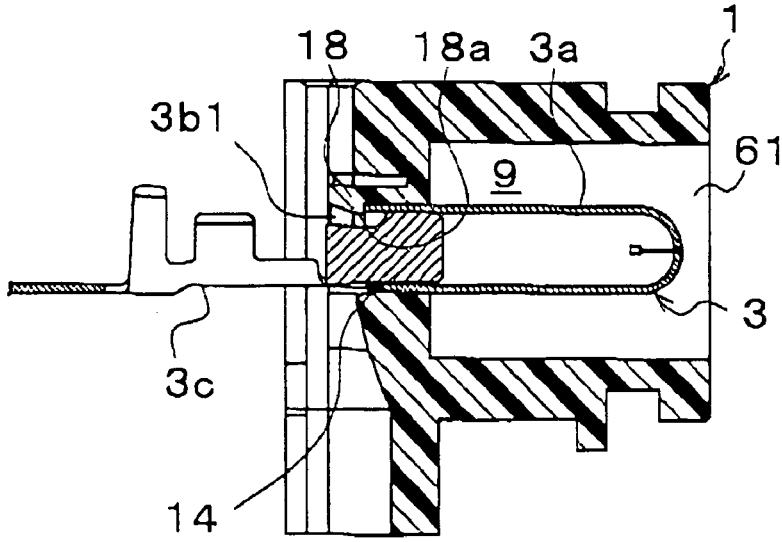

FIG. 16E shows the state in which the press-fit pin has been press-fitted inside the cylindrical main contact body 3*a* in the same sectional view as FIG. 16D. In the state illustrated in FIG. 16E, the large-diameter axial part 6*b* is held so as to be in close contact with a predetermined length (a length substantially equal to the diameter in the present embodiment) of the interior of the cylindrical main contact body 3*a*. The portion of the large-diameter axial part 6*b* of the press-fit pin 6 corresponds to the portion of the cylindrical main contact body 3*a* that is held by the first opening 14 equipped in the housing 1. By the large-diameter axial part 6 being inserted in the root portion of the cylindrical main contact body 3*a* that is otherwise held by a thin cylinder, a rigid axis, which can withstand compression in the direction of the central axis, is realized.

Here 6*d* is a notched part provided near the head of the pin. This notched part 6*d* is provided so that the nose tip part 18*a* of the lance 18 can return adequately to a predetermined position after insertion of the pin 6.

As described above, by the insertion of the press-fit pin 6, the outer diameter of the contact 3 is pressed further against the insertion opening 14 and the passage of cylindrical shape (referred to hereinafter as "cylindrical passage"). The fixing of the contact 3 is thus facilitated further. Also, in the assembly of the jack the first insertion of the contact 3 can be performed easily, and if the pin 6 that is to be press-fitted subsequently is made of metal, unnecessary wear and friction with the contact can be lessened.

What is claimed is:

1. A jack comprising:

an insulating housing and a hollow columnar contact;

wherein the insulating housing comprises:

a plug connection opening into which a mating plug is inserted;

a contact insertion chamber having an opening of the plug connection opening; and a contact insertion opening being disposed opposite to the plug connection opening, the contact insertion opening communicating with the contact insertion chamber;

wherein the hollow columnar contact being conductive is inserted along an axial direction thereof into the contact insertion chamber from the contact insertion opening, wherein the jack holds a cylindrical main contact body of the hollow columnar contact at the contact insertion opening of the housing;

wherein a press-fit pin is press-fitted inside the cylindrical main contact body, wherein the hollow columnar contact is a contact with a hollow and columnar shape, and is connected to a dedicated lead wire by crimping at a crimp part, wherein the hollow columnar contact comprises a pair of L-shaped tongues provided in a vicinity of a base part of the hollow columnar shape, the base part being provided toward the crimp part; and wherein the contact insertion opening, into which the hollow columnar contact is inserted along the axial direction, comprises;

a first latching part being provided in a vicinity of the contact insertion opening, the first latching part engaging with the pair of L-shaped tongues and restrains the rotation of the hollow columnar contact about the axial direction;

a second latching art to contact with the pair of L-shaped tongues as the hollow columnar contact is inserted into the contact insertion opening such that the hollow columnar contact is stopped at a predetermined position, wherein the hollow columnar contact further comprises a column connecting base part and an engaging base part in a vicinity of the base part of the hollow columnar contact toward the crimp part, wherein the contact insertion opening of the housing further comprises a third latching part for contacting with the engaging base part so as to prevent the hollow columnar contact from falling off the housing, wherein the press-fit pin comprises a small-diameter axial part having an outer diameter smaller than the inner diameter of the cylindrical main contact body, a large-diameter axial part having an outer diameter for a "medium fit" of fit quality with the inner diameter of the cylindrical main contact body, and a head part having an outer diameter larger than the outer diameter of the large-diameter axial part such that the outer diameter pushes and spreads the pair of L-shaped tongues, and wherein the small-diameter axial part, the large-diameter axial part, and the head part are arranged to be coaxial, and the press-fit pin is press-fitted into the cylindrical main contact body.

2. The jack according to claim 1, wherein the press-fit pin is formed of hard metal of good electroconductivity.

3. An electrical device equipped with the jack of claim 1.

4. A jack comprising:

a columnar contact of a columnar shape and an insulating housing which houses the columnar contact;

wherein the insulating housing comprises: a plug connection opening, into which a mating plug is inserted; a contact insertion chamber for receiving the mating plug to be inserted from the plug connection opening; and a contact insertion opening being in communication with the contact insertion chamber via a cylindrical passage that has a cylindrical shape of predetermined length and being provided as opposed to the plug connection opening;

wherein the columnar contact comprising is a cylindrical hollow part is in a hollow columnar shape with conductivity and is inserted along an axial direction into the contact insertion chamber from the contact insertion opening, wherein the contact insertion opening and the cylindrical passage have inner diameters of substantially the same size, which is substantially the same as or slightly larger than the outer diameter of the columnar contact so as to enable the columnar contact to be inserted readily, and wherein a press-fit pin is press-fitted into the hollow part of the hollow columnar shape of the columnar contact, wherein the columnar contact comprises: a crimp part to be connected by crimping with a lead wire: and a pair of L-shaped tongues being provided in a vicinity of a base part of the hollow columnar shape being provided toward the crimp part;

wherein the contact insertion opening, into which the hollow columnar contact is inserted along an axial direction, comprises:

a first latching part being provided in a vicinity of the contact insertion opening, the first latching part engaging with the pair of L-shaped tongues so as to restrains rotation of the hollow columnar contact about the axial direction; and a second latching part to contact with the pair of L-shaped tongues as the hollow columnar contact is inserted into the contact insertion opening to stop the hollow columnar contact at a predetermined position, wherein the columnar contact further comprises a column connecting base part and an engaging base part in a vicinity of the base part, wherein the contact insertion opening of the housing further comprises a third latching part for latching onto the engaging base part and thereby preventing falling-off of the columnar contact from the housing, and wherein the press-fit pin comprises a small-diameter axial part with an outer diameter smaller than the inner diameter of the hollow part; a large-diameter axial part with an outer diameter that is substantially the same as or slightly larger than the inner diameter of the hollow part; and a head part with an outer diameter having a larger outer diameter than that of the large-diameter axial part such that the outer diameter is inserted to push and spread the pair of L-shaped tongues, wherein the small-diameter axial part, the small-diameter axial part, and the head part are provided in the order from a front end of the pin in the insertion direction to be coaxial.

5. The jack according to claim 4, wherein the press-fit pin is provided with a large-diameter axial part with an outer diameter that is substantially the same as or slightly larger than the inner diameter of the hollow part of the columnar contact, wherein the columnar contact comprises: a crimp part being connected by crimping with a lead wire: and a pair of L-shaped tongues being provided near a base part of the hollow columnar shape toward the crimp part; wherein the contact insertion opening, into which the hollow columnar contact is inserted along an axial direction, comprises: a first latching part being provided in a vicinity of the contact insertion opening, the first latching part engaging with the pair of L-shaped tongues so as to restrains rotation of the hollow columnar contact about the axial direction; and a second latching part to contact with the pair of L-shaped tongues as the hollow columnar contact is inserted into the contact insertion opening to stop the hollow columnar contact at a predetermined position, wherein the columnar contact further comprises a column connecting base part and an engaging base part in a vicinity of the base part, wherein the contact insertion opening of the housing further comprises a third latching part for latching onto the engaging base part and thereby preventing falling-off of the columnar contact from the housing, and wherein the press-fit pin comprises a small-diameter axial part with an outer diameter smaller than the inner diameter of the hollow part, a large-diameter axial part with an outer diameter that is substantially the same as or slightly larger than the inner diameter of the hollow part; and a head part with an outer diameter having a larger outer diameter than that of the large-diameter axial part such that the outer diameter is inserted to push and spread the pair of L-shaped tongues, wherein the small-diameter axial part, the small-diameter axial part, and the head part are provided in the order from a front end of the pin in the insertion direction to be coaxial.

6. An electrical device equipped with the jack of claim 4.

* * * * *